US007483544B2

(12) United States Patent
Wright et al.

(10) Patent No.: US 7,483,544 B2
(45) Date of Patent: Jan. 27, 2009

(54) AUDIO DEVICE POST EXTENSION AND ANGLING SYSTEM

(76) Inventors: Doug S. Wright, 3554 Quincy Ave., Simi Valley, CA (US) 93063; Vance Dickason, 4330 Imperial Dr., West Linn, OR (US) 97068

( * ) Notice: Subject to any disclaimer, the term of this patent is extended or adjusted under 35 U.S.C. 154(b) by 526 days.

(21) Appl. No.: 11/040,949

(22) Filed: Jan. 21, 2005

(65) Prior Publication Data

US 2005/0123156 A1 Jun. 9, 2005

Related U.S. Application Data

(63) Continuation-in-part of application No. 10/885,861, filed on Jul. 7, 2004, now Pat. No. 7,121,756.

(60) Provisional application No. 60/497,752, filed on Aug. 26, 2003.

(51) Int. Cl.
*H04R 1/02* (2006.01)

(52) U.S. Cl. ..... 381/336; 381/332

(58) Field of Classification Search ..... 381/87, 381/150, 182, 332, 334, 335, 386; 181/144, 181/145, 146

See application file for complete search history.

(56) References Cited

U.S. PATENT DOCUMENTS 6,002,780 A * 12/1999 Espiritu ..... 381/182
6,006,399 A * 12/1999 Massaro ..... 15/315
6,101,262 A * 8/2000 Haase et al. ..... 381/386
6,282,297 B1 * 8/2001 Lin ..... 381/386

* cited by examiner

*Primary Examiner*—Brian Ensey
(74) *Attorney, Agent, or Firm*—Loza & Loza, LLP; Julio M. Loza

(57) ABSTRACT

One embodiment of the invention provides a post extension system frame assembly for mounting fixtures within a recess in a wall or ceiling and that can be adjusted and installed with minimal time and effort. One feature of the invention provides a post extension mechanism that can be manually installed and/or adjusted to position a first audio device either above or below the mounting surface and an angling mechanism permits adjusting the direction and angle of the audio device to permit positioning the sound dispersion axis of the audio device (e.g., speaker, tweeter, woofer, audio transducer, etc.) directly towards a listener. Another feature of the invention provides a rotating angling mechanism that permits adjusting the sound dispersion axis of a recessed second audio device.

21 Claims, 25 Drawing Sheets

AUDIO DEVICE POST EXTENSION AND ANGLING SYSTEM

CROSS REFERENCE TO RELATED APPLICATIONS

This non-provisional United States (U.S.) Patent Application is a continuation-in-part application of, and claims priority on, non-provisional U.S. patent application Ser. No. 10/885,861 by Doug Wright et al., titled "Audio Device Post Extension and Angling System", filed on Jul. 7, 2004, now U.S. Pat. No. 7,121,756 and claims priority on, non-provisional U.S. patent application Ser. No. 10/871,111 by Doug Wright, titled "Angled Speaker Assembly", filed on Jun. 18, 2004, both of which claim priority on provisional U.S. Patent Application No. 60/497,752, filed Aug. 26, 2003; and is related to U.S. patent application Ser. No. 10/871,112 by Doug Wright, titled "Tool-less Frame Fastening System", filed on Jun. 18, 2004; and is also related to U.S. patent application Ser. No. 10/871,069 by Doug Wright, titled "Snap-In and Lock Baffle", filed on Jun. 18, 2004. The contents of all these related applications is hereby incorporated by reference.

FIELD

Various embodiments of the invention pertain to in-wall audio devices. More particularly, at least one embodiment of the invention relates to an extendable post and angling system for mounting an audio tweeter within a wall or ceiling recess and a speaker assembly that permits adjusting the dispersion axis of a recessed speaker.

DESCRIPTION OF RELATED ART

In order to save space and/or for aesthetic reasons it is often desirable to mount speakers within a wall or ceiling cavity or recess. Audio devices, such as speakers, woofers and/or tweeters, are often mounted within a wall or ceiling cavity or recess. Various types of frames and/or fasteners are used for the purpose of securing the audio devices within a wall or ceiling cavity.

Mounting such audio devices within a recessed cavity poses several problems. For instance, mounting an audio device inside a ceiling cavity may prevent the sound emitted from such device from directly reaching listeners. A speaker mounted in a wall or ceiling using a conventional frame assembly typically has a sound dispersion axis that is perpendicular to the plane formed by the mounting surface, e.g., wall or ceiling. However, speakers with sound dispersion axes directed at the floor or an opposing wall often do not provide an environment with optimum sound quality. Thus, when installing one or more speakers in a room, it is often desirable to adjust the angle of one or more of the speakers to provide a better sound quality or effect.

It is often necessary or desirable to adjust the direction in which, for instance, a ceiling-mounted speaker radiates sound. For example, when providing a surround sound effect with one or more recessed speakers, the sound dispersion axis of the speakers is adjusted to provide optimum sound quality at a given point or location in the room.

However, conventional speaker mounting systems make it difficult to adjust the sound dispersion axis of a speaker to provide an optimum sound quality. For example, many conventional speakers are fixedly mounted in a wall or ceiling recess and cannot be adjusted. Additionally, even when adjustments to the speakers are possible, prior art mounting mechanisms are typically restricted to a limited number of positions. This may not always permit directing a speaker's sound dispersion axis to obtain the best sound quality in a particular room or environment.

Adjusting a conventional mounting mechanism to position the audio device at the correct depth, direction, and angle may also be burdensome or impossible. That is, it may not be possible to direct the sound dispersion axis of the recessed audio device to reach a listener directly. As a result sound quality may be affected.

When mounting a tweeter, for instance, the tweeter is typically fixedly secured in a mounting base. The mounting base may then be secured to a supporting mechanism within a ceiling cavity, for instance. However, conventional mounting mechanisms do not permit to easily adjust the position (e.g., depth, direction, and angle) of the tweeter.

Additionally, conventional mounting systems and fasteners are typically cumbersome and time-consuming to install, take many steps to mount, and require the use of several tools. This increases the cost of installation and deployment of, for instance, recessed speakers, lights, or exhaust fans.

Even when the speakers can be adjusted, they are often difficult and/or cumbersome to readjust at a later time. This may be necessary, for instance, in a surround sound speaker configuration that has been setup for optimal sound quality at a first location and now the optimal sound quality is desired at a second location. Such is the case, for example, when a couch is moved from a first location to a second location in a room. Readjusting conventional speakers is typically requires removal and reinstallation of the speaker and/or speaker mounting assembly which is undesirable and costly.

SUMMARY

One embodiment of the invention relates to a speaker mounting assembly including a speaker frame defining a housing to receive a speaker. The speaker frame has a first plane along the face of the speaker frame. The speaker frame includes a flange around the perimeter of the speaker frame, the flange defines a second plane that is at an angle to the first plane. The speaker frame also includes a baffle which defines an interior opening to receive the speaker frame and a third plane along the face of the baffle. The baffle includes an angled ridge along the perimeter of the interior opening, the ridge defining a fourth plane that is at an angle to the third plane, the ridge defining a perimeter that is smaller than the perimeter defined by the flange. The ridge to support the flange when the speaker frame is coupled to the baffle. A clamp frame is coupled to the baffle to secure the speaker frame between the baffle and the clamp frame while permitting the speaker frame to rotate about a first axis perpendicular to the first plane. The angle of the first plane of the speaker frame, relative to the third plane of the baffle, being adjustable within a range by rotating the speaker frame about the first axis.

The speaker mounting assembly includes a groove that is formed by the clamp frame and the ridge when the clamp is coupled to the baffle. The flange slides within this groove when the speaker frame is rotated about the first axis. The baffle further includes a grooved channel along a first section defining the interior opening, the grooved channel to receive a stop pin coupled to the flange and limit the rotation of the speaker frame to the first section.

As a result of this construction, the speaker frame assembly is capable of being adjusted to any angle, relative to the third plane of the baffle, between a minimum angle and a maximum angle by rotating the speaker frame assembly about the first axis.

Another embodiment of the invention provides a post extension and angling system for mounting fixtures/audio devices within a recess in a wall or ceiling that can be adjusted and installed with minimal time and effort. One feature of the invention provides a post extension and angling mechanism that can be manually installed and/or adjusted to set the depth, direction and angle of an audio device so as to be able to position the sound dispersion axis of the audio device (e.g., speaker, tweeter, woofer, audio transducer, etc.) directly towards a listener.

According to one implementation of the invention, a method and system for extending the position of a ceiling-mounted tweeter to just below the ceiling surface is provided. Making the tweeter system extendable, in concert an angling system, enables the tweeter to be placed in a position that allows the listener to be directly on-axis with the tweeter, even when the listener is at an extreme angle to the speaker system. By making the tweeter system extendable, as opposed to being fixed in an extended position, the installer has the option of retaining a more conventional "flush" installation for those occasions when the installation is more aesthetically sensitive than acoustically sensitive.

According to one embodiment of the invention, a recessed speaker assembly is mounted inside an opening in a ceiling, wall, or other surface with the exposed face trim sitting substantially flush with the mounting surface. One or more audio devices and may be mounted within the recessed speaker assembly. For example, a first audio device may be a speaker or woofer, and a second audio device may be a tweeter, mid-range speaker, and/or sub-woofer.

The first audio device may be supported by a rotating angling system. The second audio device may be supported on a ball-and-socket angling system that is coupled to the telescoping post mechanism. This permits independent adjustment of the position and/or angle of the second audio device relative to the first audio device.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

In the following description, certain terminology is used to describe certain features of one or more embodiments of the invention. For instance, "fastener" and "retainer" are interchangeably used to refer to any type of securing mechanism. The term "audio device" is used to refer to any type of sound-generating device, including a speaker, loudspeaker, audio speaker, woofer, subwoofer, tweeter, and/or acoustic transducer. The term "manually" refers to a motion or task performed by hand and without the aid of a tool. The terms "telescoping", "extendable", and "adjustable" are used interchangeably to refer to a mechanism that can increase and decrease in length or that can be extended and retracted relative to a reference point.

One aspect of the invention provides a speaker mounting assembly that permits positioning the sound dispersion axis of a recessed speaker in any direction and at any desired angle within a range of angles. Another aspect of the invention permits manually readjusting the direction and angle of a speaker without removal of the speaker.

Figure 1:
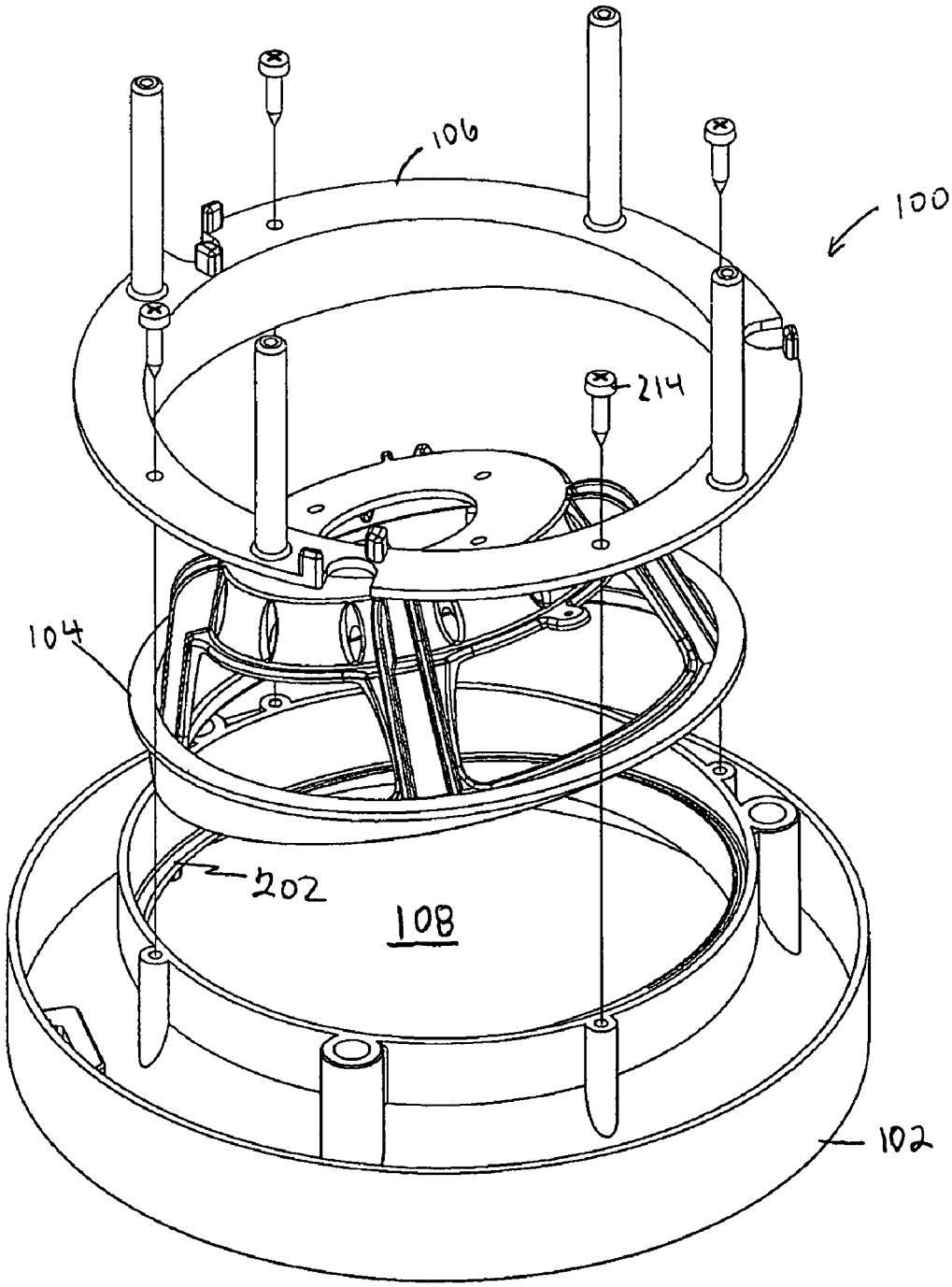
FIG. 1 illustrates an exploded perspective view of a speaker mounting assembly according to one embodiment of the invention.

FIG. 1 illustrates an exploded perspective view of a speaker mounting assembly 100 according to one embodiment of the invention. The speaker mounting assembly 100 includes a rotating baffle 102, a speaker frame 104, and a speaker frame clamp 106. The rotating baffle 102 is rotationally mounted and secured to a mounting assembly, typically, within a wall or ceiling recess. The baffle 102 also includes an opening 108 to permit sounds from a speaker mounted on the speaker frame 104 to propagate. The speaker frame 104 may house an audio speaker and is rotationally secured to the rotating baffle 102 by the frame clamp 106.

Figure 2:
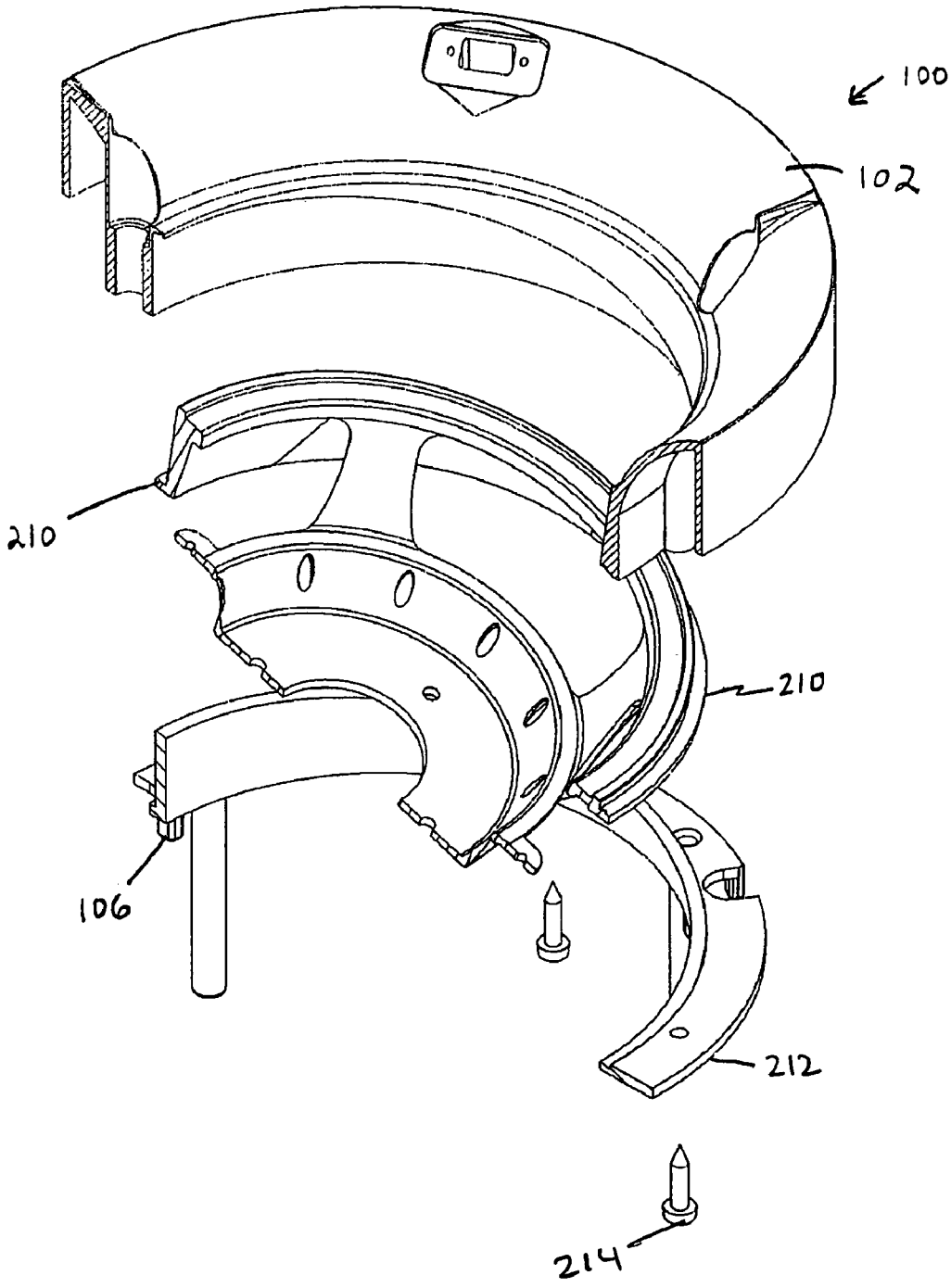
FIG. 2 illustrates a perspective cross-sectional view of the speaker mounting assembly of FIG. 1 according to one embodiment of the invention.

FIG. 2 illustrates a perspective cross-sectional view of the speaker mounting assembly of FIG. 1 according to one embodiment of the invention. The baffle 102 includes a ridge 202 angled from a first end 204 to a second end 206 of the interior vertical wall 208 defining the opening 108. That is, the ridge 202 extends all the way around the interior vertical wall 208 but at a different height along the wall 208. Consequently, the plane defined by the ridge 202 is at an angle to the planed defined by the face of the baffle.

The ridge 202 protrudes from the vertical wall 208 such that opening 108 has a slightly smaller diameter at the baffle 102 face than at the rear portion of the baffle 102. The opening 108 has a diameter large enough to permit the speaker frame 104 to be mounted therein. The ridge 202 slightly reduces the diameter of the opening 108 such that the speaker frame 104 rests on the ridge 202. This causes the speaker frame 104 to rest on the ridge 202 when the speaker mounting assembly is assembled. When resting against the ridge 202, the speaker frame 104 is able to slide on the ridge 202 and rotate within the baffle 102. The speaker frame 104 may include a flange 210, around the circumference of the frame, which slides against the ridge 202.

The speaker frame clamp 106 secures the frame assembly 104 to the baffle 102. One implementation of the speaker frame clamp 106 includes a securing ring 212 through which fasteners 214 may be placed to fixedly couple the frame clamp 106 to the baffle 102.

Figure 3:
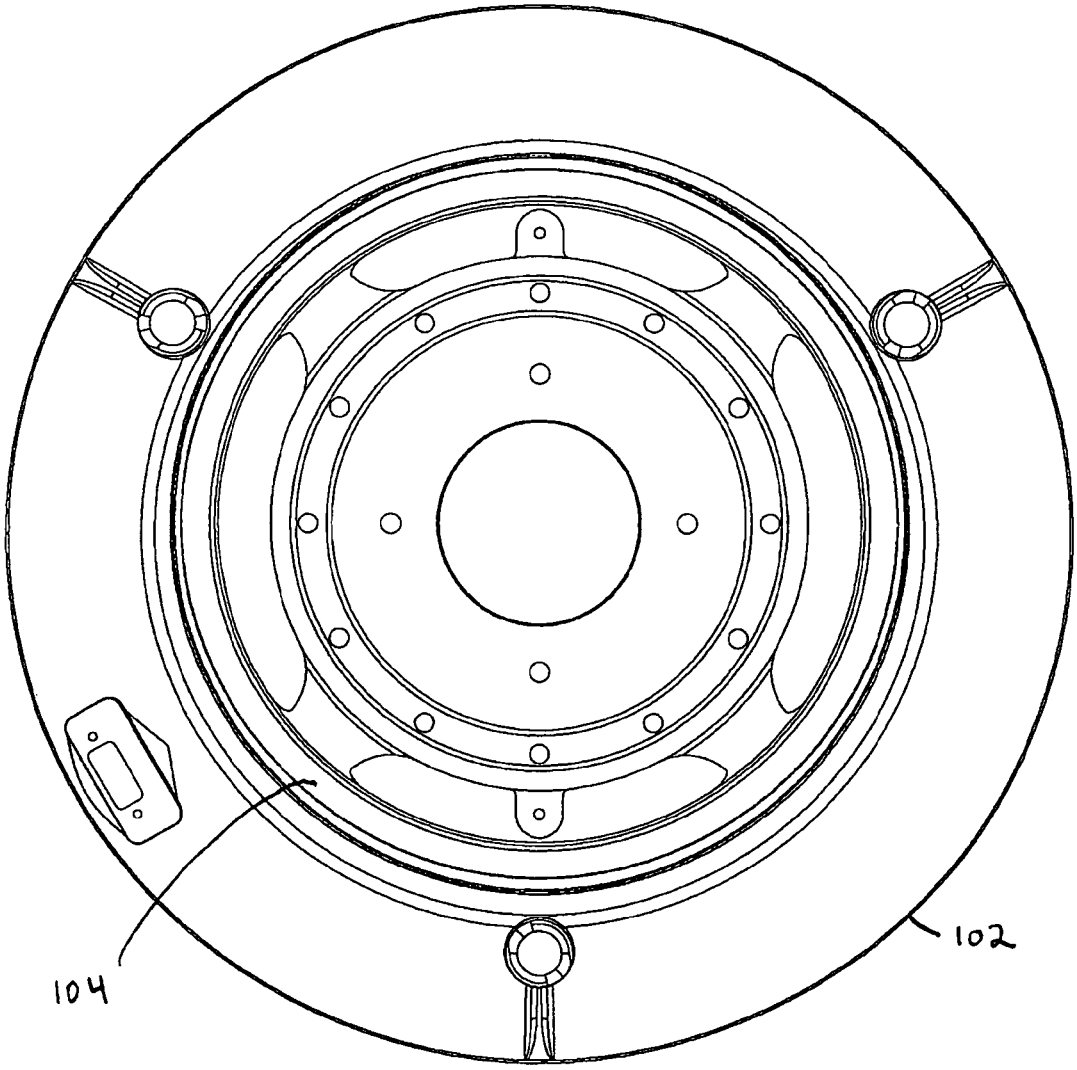
FIG. 3 illustrates a frontal view of the speaker mounting assembly of FIG. 1 according to one embodiment of the invention.

FIG. 3 illustrates a frontal view of the speaker mounting assembly of FIG. 1 according to one embodiment of the invention. The speaker frame 104 is inserted within the baffle 102 when the mounting assembly is assembled.

Figure 4:
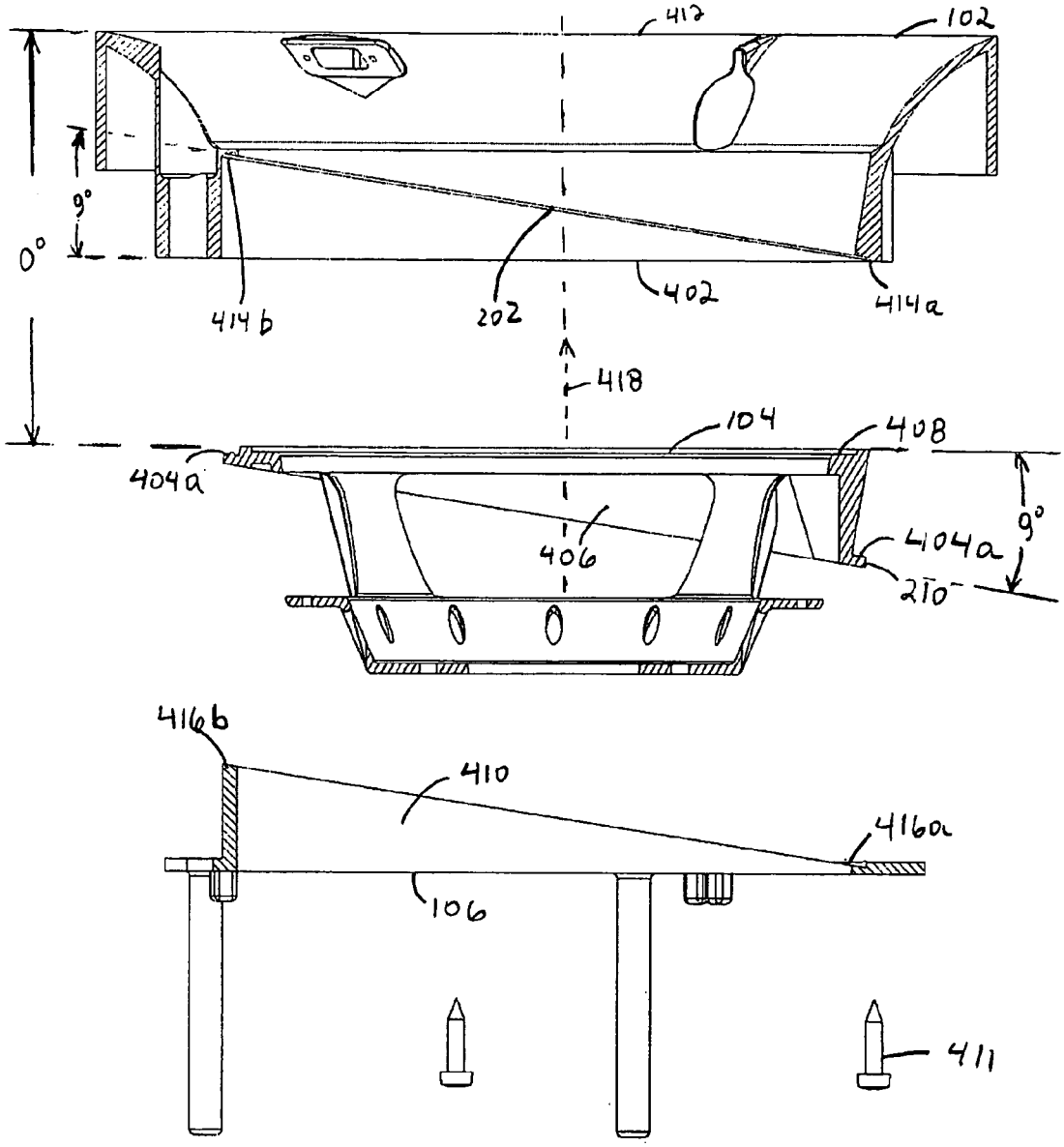
FIG. 4 illustrates an exploded sectional view of the speaker mounting assembly of FIG. 3 with the speaker frame in a first position according to one embodiment of the invention.

FIG. 4 illustrates an exploded sectional view of the speaker mounting assembly of FIG. 3 with the speaker frame in a first position according to one embodiment of the invention. This figure illustrates the orientation of the speaker frame 104 relative to the baffle 102 in a first position. In this embodiment of the invention, the ridge 202 has an angle of approximately nine (9) degrees relative to the rear plane 402 of the speaker frame 104.

The speaker frame 104 also includes an angled flange 210 along the perimeter of a vertical wall 406. In one implementation of the invention the flange 210 is angled by making he vertical wall 406 higher at one than at a second end. Consequently, the plane defined by the flange 210 is at an angle relative to the plane defined by the speaker frame's face plane 408.

In one implementation, the angled flange 210 has the same angle as the ridge 202, (e.g., nine (9) degrees) relative to the face plane 408 of the speaker frame 104. When assembled, the speaker frame 104 is inserted into the baffle 102 so that the flange 210 sits on the ridge 202.

The speaker frame clamp 106 is then inserted into the baffle 102. In one implementation of the invention, the speaker frame clamp 106 includes an angled wall 410 with the same angle as the angled flange 210 of the speaker frame 104. When assembled, the speaker frame clamp 106 is inserted into the baffle 102 to retain the speaker frame 104 within the baffle 102. The angled wall 410 and the ridge 202 form a groove in which the speaker frame flange 210 can slide. One or more fasteners 411 serve to couple the speaker frame clamp 106 to the baffle 102.

FIG. 4 illustrates a first position or orientation of the speaker frame. In this position, the angle of the ridge 202 and the angle of the flange 410 substantially cancel each other such that the speaker frame face plane 408 is substantially parallel to the baffle face plane 412. When assembled, the speaker frame flange portion 404*a* rests against the ridge portion 414*a*. Similarly, speaker frame flange portion 404*b* rests against ridge portion 414*b*. The angled wall portions 416*a* and 416*b* are inserted adjacent to the speaker frame flange portions 404*a* and 404*b* respectively. In this position, a speaker mounted within the speaker frame 104 would have a sound dispersion axis 418 substantially perpendicular to the face of the face plane 412 of the baffle 408 mounting surface, e.g., wall or ceiling.

Figure 5:
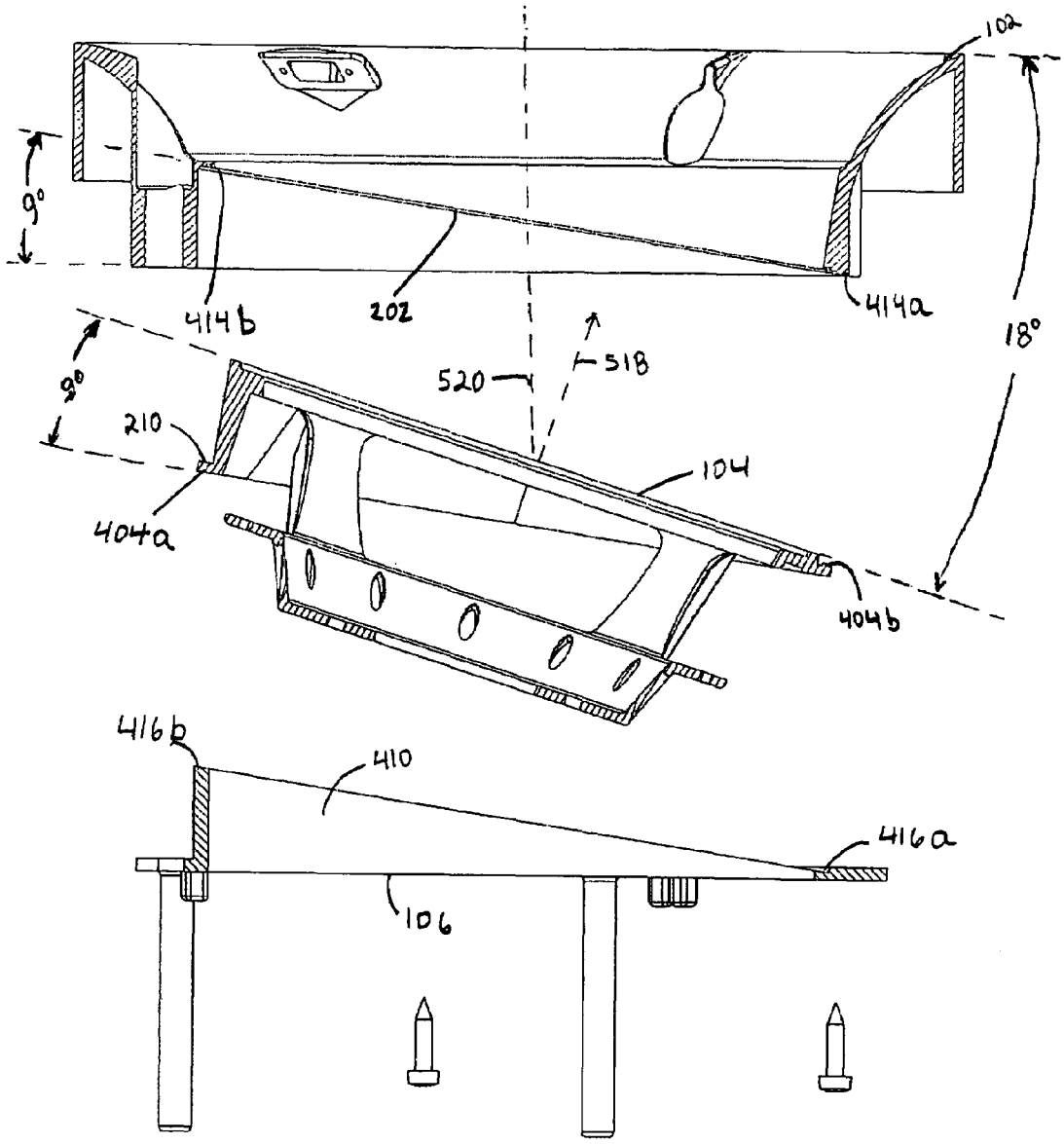
FIG. 5 illustrates an exploded cross-sectional view of the speaker mounting assembly of FIG. 3 with the speaker frame in a second position according to one embodiment of the invention.

FIG. 5 illustrates an exploded cross-sectional view of the speaker mounting assembly of FIG. 3 with the speaker frame in a second position according to one embodiment of the invention. In FIG. 5, the speaker frame 104 has been rotated one hundred and eighty (180) degrees from the position illustrated in FIG. 4 relative to the baffle 102. In this orientation, the angle of the ridge 202 and the angle of the flange 210 are cumulative such that the speaker frame face plane 408 is at an angle to the baffle face plane 412. For example, if the angle of the ridge 202 is nine (9) degrees and the angle of the flange 210 is nine (9) degrees, then the maximum angle that can be formed by the ridge 202 and flange 210 is eighteen (18) degrees.

In FIG. 5, the speaker frame flange portion 404*a* rests against ridge portion 414*b* while flange portion 404*b* rests against ridge portion 414*a*. In this position, a speaker mounted within the speaker frame 104 would have a sound dispersion axis 518 angled at eighteen (18) degrees from an axis 520 perpendicular to the mounting surface, e.g., wall or ceiling.

As a result of the angled ridge 202 and angled flange 210, the speaker frame 104 can be adjusted to any angle within a range, e.g., zero degrees and a maximum angle, by rotating the speaker frame 104. This permits adjusting the sound dispersion axis 518 to any angle within the range. The maximum angle that can be achieved being dependent on the sum of the relative angle of the ridge and the relative angle of the flange.

By forming a groove or channel between the angled ridge 202 and the vertical wall 410, the speaker frame flange 210 is able to slide in this groove. In this manner, the speaker frame 104 can be rotated to direct the sound dispersion axis 518 of a speaker mounted thereon to a desired location within a room or environment. The ease with which the speaker frame 104 can be turned is adjusted by slightly increasing or reducing the size of the groove so as to create a looser or tighter fit with the flange 210. As previously noted, this can be accomplished by loosening or tightening the fasteners 411 to adjust the separation between the frame clamp's vertical wall 410 and baffle's angled ridge 202.

Figure 6:
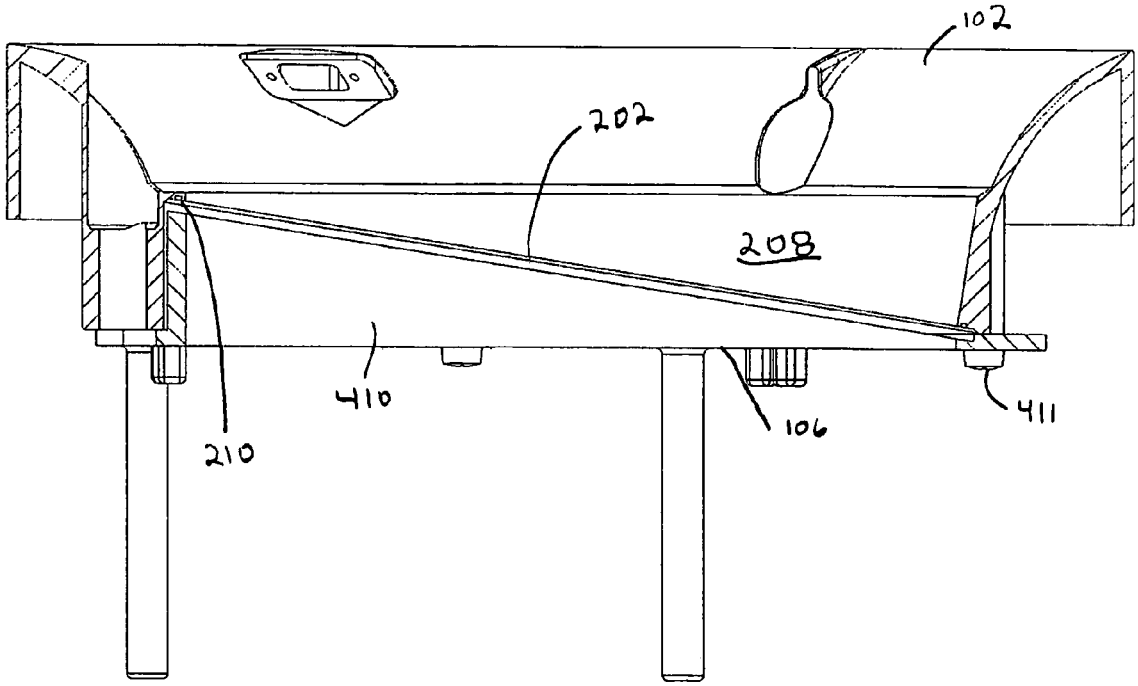
FIG. 6 illustrates a cross-sectional side view of the assembled speaker mounting assembly of FIG. 1 according to one embodiment of the invention.

FIG. 6 illustrates a cross-sectional side view of the assembled speaker mounting assembly of FIG. 1 according to one embodiment of the invention. As shown, the speaker frame clamp 106 is coupled to the baffle 102 using a plurality of fasteners 411. The speaker frame flange 210 is held be between the frame clamp's angled wall 410 and the baffle's ridge 202. The frame clamp 106 is positioned within the baffle 102 so that the angled wall 410 complements the angle of the ridge 202. This results in an evenly spaced groove for the speaker frame flange 210.

According to one implementation of the invention, the speaker frame 104 can rotate within the groove when the fasteners 411 are loosened slightly. Once adjusted to a desired position, the fasteners 411 are tightened, thereby reducing the size of the groove formed by the angled wall 410 and ridge 202, to prevent any further rotation of the speaker frame 104.

Another aspect of the invention provides a way to limit the rotation of the speaker frame 104. This prevents speaker wires from being torn or tangled if a speaker frame 104 is rotated many times in one direction.

Figure 7:
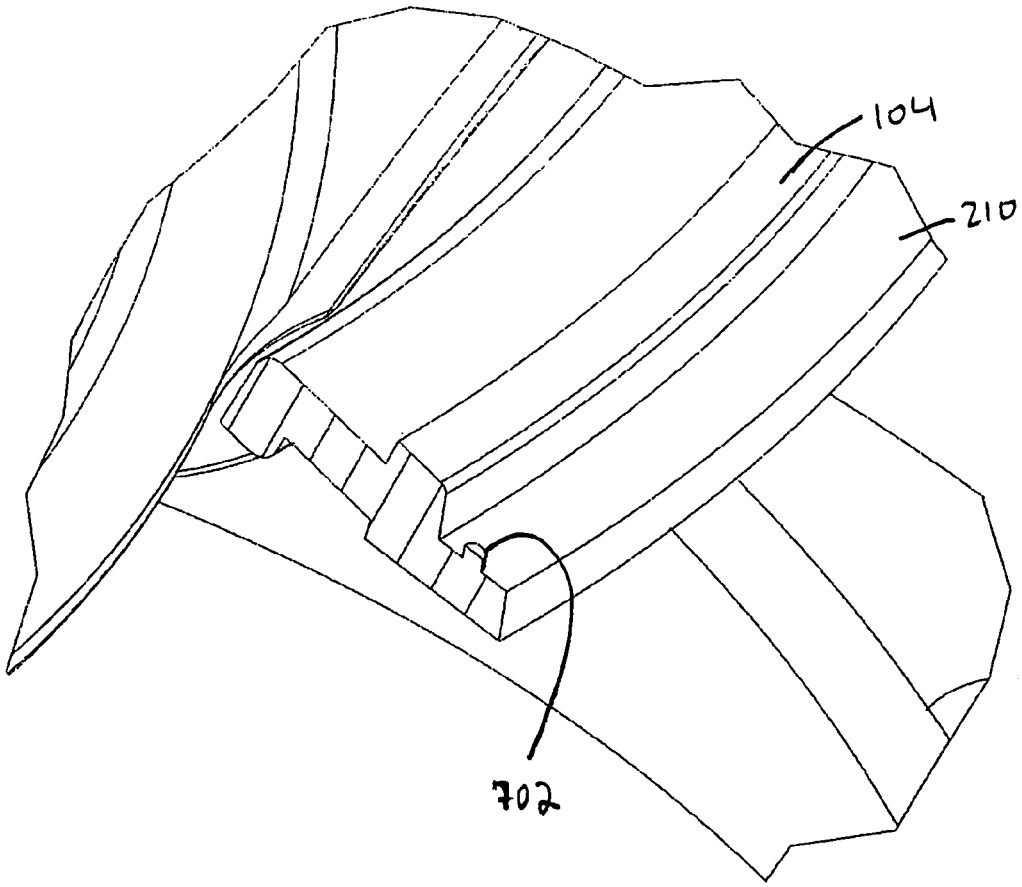
FIG. 7 illustrates a rotation stop pin for the speaker mounting assembly of FIG. 1 according to one embodiment of the invention.

FIG. 7 illustrates a rotation stop pin 702 for the speaker mounting assembly 100 of FIG. 1 according to one embodiment of the invention. The speaker frame 104 includes a stop pin 702 along the speaker frame flange 210. When the speaker mounting assembly 100 is assembled, the stop pin 702 limits the rotation of the speaker frame 104.

Figure 8:
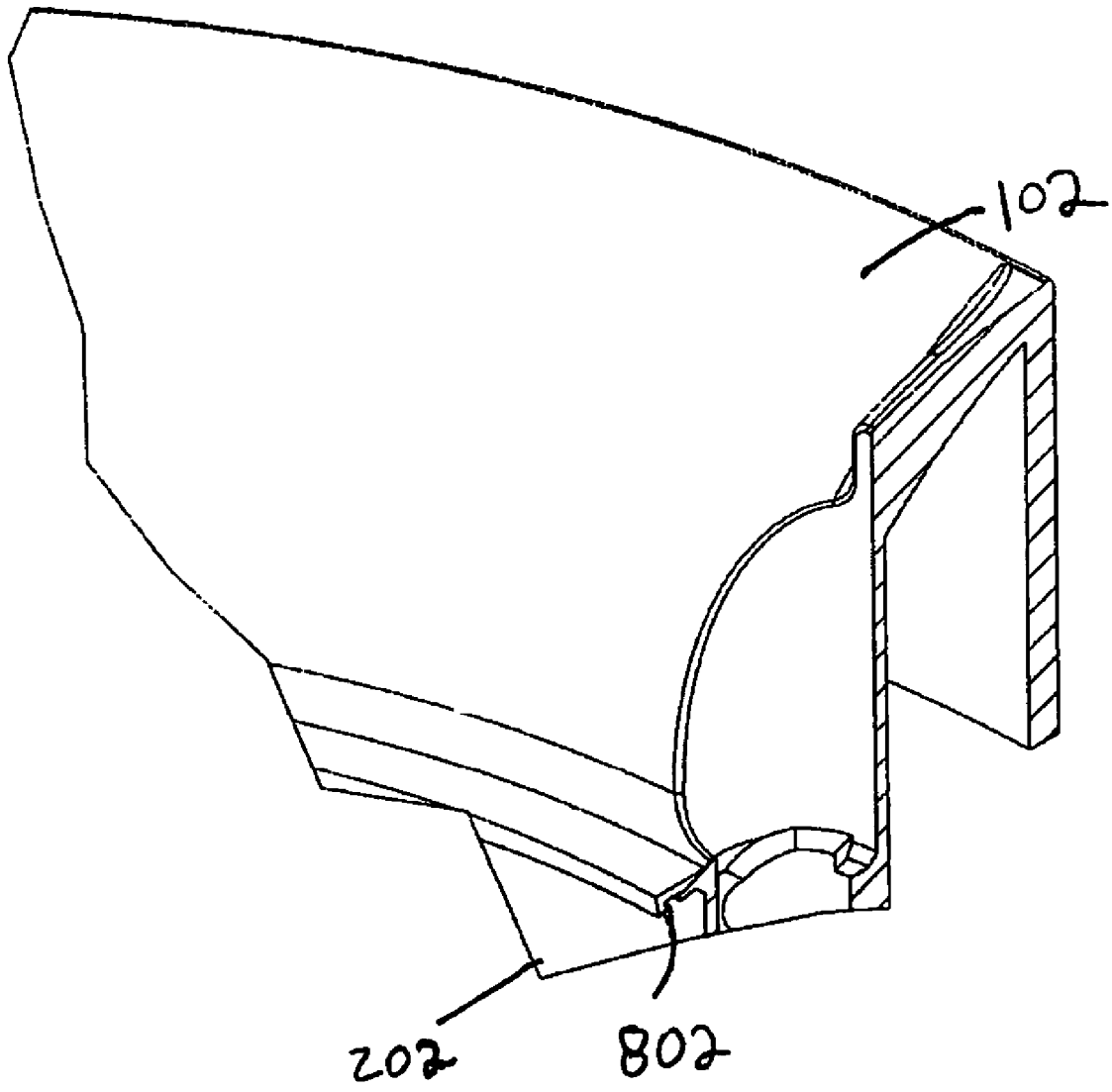
FIG. 8 illustrates a baffle having a groove along its ridge to accept a rotation stop pin according to one embodiment of the invention.

According to one implementation of the invention, illustrated in FIG. 8, the baffle's ridge 202 includes a groove 802 along a portion of the ridge 202 in which the stop pin 702 can ride. Thus, the length of the groove 802 in the ridge 202 limits the rotation of the speaker frame 104. For example, the groove 802 may run only half way along the circumference of the ridge 202 to limit the rotation of the speaker frame 104 to approximately one hundred eighty (180) degrees. Such groove 802 can be used to limit the rotation of the speaker frame 104 anywhere from zero (0) to three hundred and sixty (360) degrees.

In other implementations of the invention the stop pin is coupled to the speaker frame flange 210 and positioned facing the frame clamp 106. The groove may be part of the frame clamp 106. In yet another implementation of the invention, the stop pin may be directed toward a grooved channel in the vertical wall 208 of the baffle. In yet other embodiments, the grooved channel is part of the speaker frame 104 and engages a stop pin that is part of either the baffle 102 or frame clamp 106.

Figure 9:
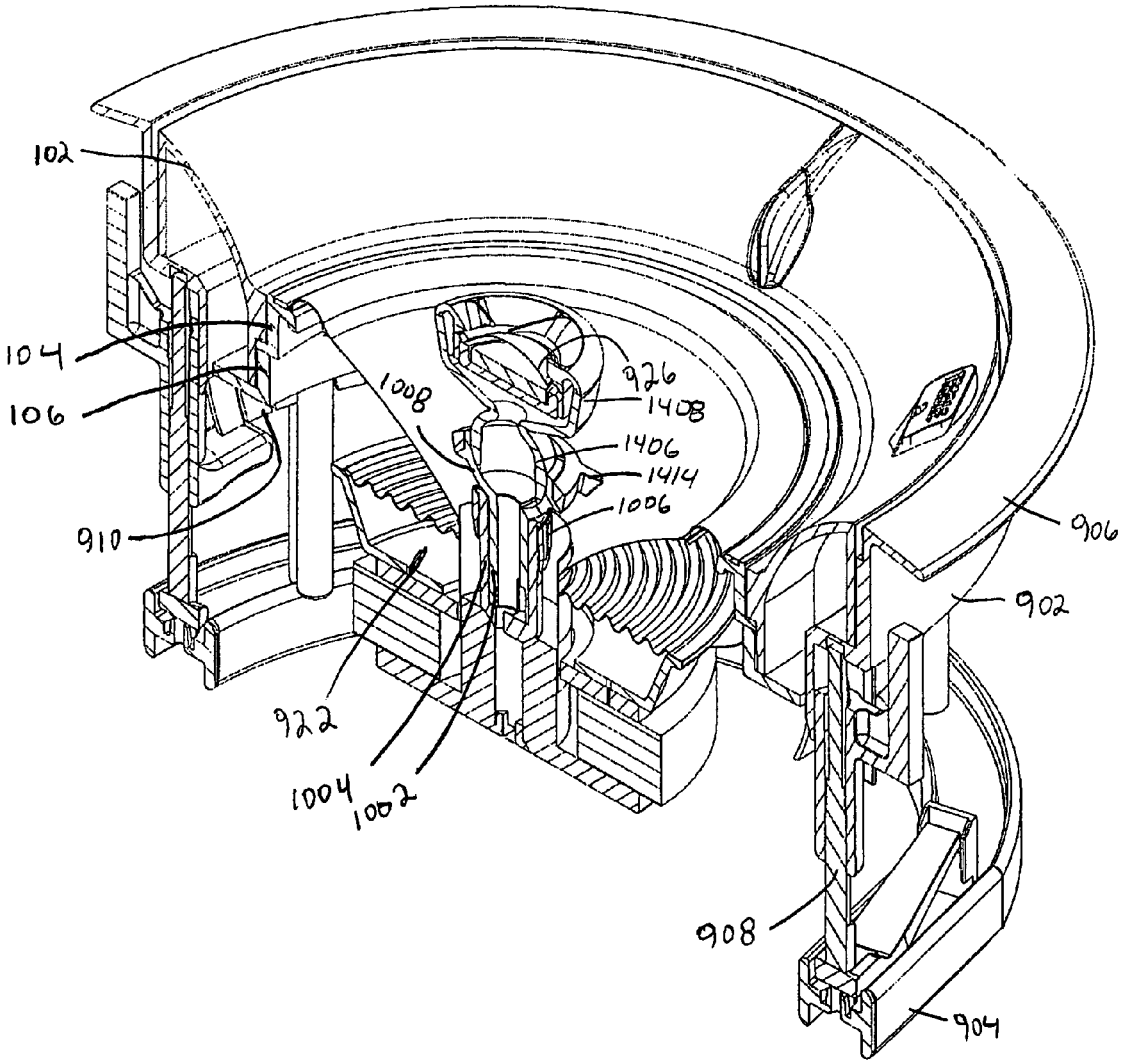
FIG. 9 illustrates a cross-sectional view of a tool-less fastening system in which the speaker mounting assembly of FIG. 1 may be inserted and secured according to one embodiment of the invention.

FIG. 9 illustrates a tool-less fastening system in which the speaker mounting assembly of FIG. 1 may be inserted and secured according to one embodiment of the invention. This fastening system does not require the use of hand-tools or power-tools for its installation, aside from a saw to cut the receiving hole or recess in the wall or ceiling. However, other fastening systems, including those that require tools for installation, may be used without departing from the invention.

The tool-less fastening system includes a primary mounting frame 902 and a retaining frame 904. According to one implementation of the invention, the primary mounting frame 902 is substantially circular and defines a cavity or opening through which a speaker baffle 102 may be mounted. The primary mounting frame 902 may include a border flange 906 that may serve as an external trim once the primary mounting frame 902 is mounted within a ceiling or wall recess. The primary mounting frame also includes a plurality of posts on which the retaining frame may be coupled by a pressure fit or one or more fasteners.

The primary mounting frame 902 may also include one or more ratcheting retainers or fasteners 908. Each ratcheting retainer 908 is movably coupled to the primary mounting frame 902. The retaining frame is coupled to one or more posts to secure the tool-less fasteners or retainers between the primary frame 902 and retaining frame 904. Each ratcheting retainer 908 is adapted to be manually rotated and slid to secure the primary mounting frame 902 to a mounting surface. The border flange 906 and the ratcheting retainers 908 sandwich the mounting surface to secure the primary mounting frame 902 to the mounting surface. In this manner, the primary mounting frame 902 may be installed within a recessed space with the border flange 906 substantially flush with the mounting surface.

The primary frame 902 also includes a plurality of flexible fingers 910 that help to align and secure the baffle frame 102 that is inserted into the opening. The plurality of flexible fingers 910 are inclined or disposed toward the opening of the primary mounting frame 902.

The baffle frame 102 is configured to fit snug through the primary mounting frame opening. The fingers 910 on the primary frame 902 flex back as the baffle frame 102 is inserted into the opening.

According to one embodiment of the invention, the baffle frame 102 includes a plurality of fasteners that secure the baffle 102 to the primary mounting frame 902. The fasteners pass from the face of the baffle 102 to the rear of the baffle to secure the baffle to the primary mounting frame 902. The fasteners can be manually rotated to slide a securing foot over the retaining fingers 910 and secure the baffle 102 in place.

Even when the fasteners secure the baffle 102 to the primary mounting frame 902, the baffle frame 102 can freely rotate three hundred and sixty degrees as the fastener footings slide over the retaining fingers 910. This permits two ways in which to adjust the sound dispersion axis of a speaker mounted in a speaker frame within the baffle 102.

First, as previously discussed, the speaker frame 104 can be rotated to adjust the angle of the sound dispersion axis of a speaker, or any other sound transducer device, mounted therein. The rotation of the speaker frame 104 relative to the baffle causes the angle of the speaker 104 to change within a certain range of angles, thus changing the angle of the sound dispersion axis of the speaker relative to the mounting surface.

Secondly, once the dispersion angle has been adjusted, the baffle 102 can be rotated relative to the primary mounting frame 902 to adjust the direction of the sound dispersion axis. Thus, sound from a speaker can be directed to a desired location within a room.

By using the angle and direction adjusting speaker frame described, a plurality of recessed speakers can be easily and quickly arranged to provide a desired sound quality in a room. For instance, a plurality of speakers may be adjusted to direct sound to a particular location in a room thus improving the sound quality at that location.

Another embodiment of the invention provides a post extension and angling system for mounting fixtures/audio devices within a recess in a wall or ceiling that can be adjusted and installed with minimal time and effort. One feature of the invention provides a post extension and angling mechanism that can be manually installed and/or adjusted to set the depth, direction and angle of an audio device so as to be able to position the sound dispersion axis of the audio device (e.g., speaker, tweeter, woofer, audio transducer, etc.) directly towards a listener.

According to one implementation of the invention, a method and system for extending the position of a ceiling-mounted tweeter to just below the ceiling surface is provided. Making the tweeter system extendable, in concert an angling system, enables the tweeter to be placed in a position that allows the listener to be directly on-axis with the tweeter, even when the listener is at an extreme angle to the speaker system. By making the tweeter system extendable, as opposed to being fixed in an extended position, the installer has the option of retaining a more conventional "flush" installation for those occasions when the installation is more aesthetically sensitive than acoustically sensitive.

Figure 10:
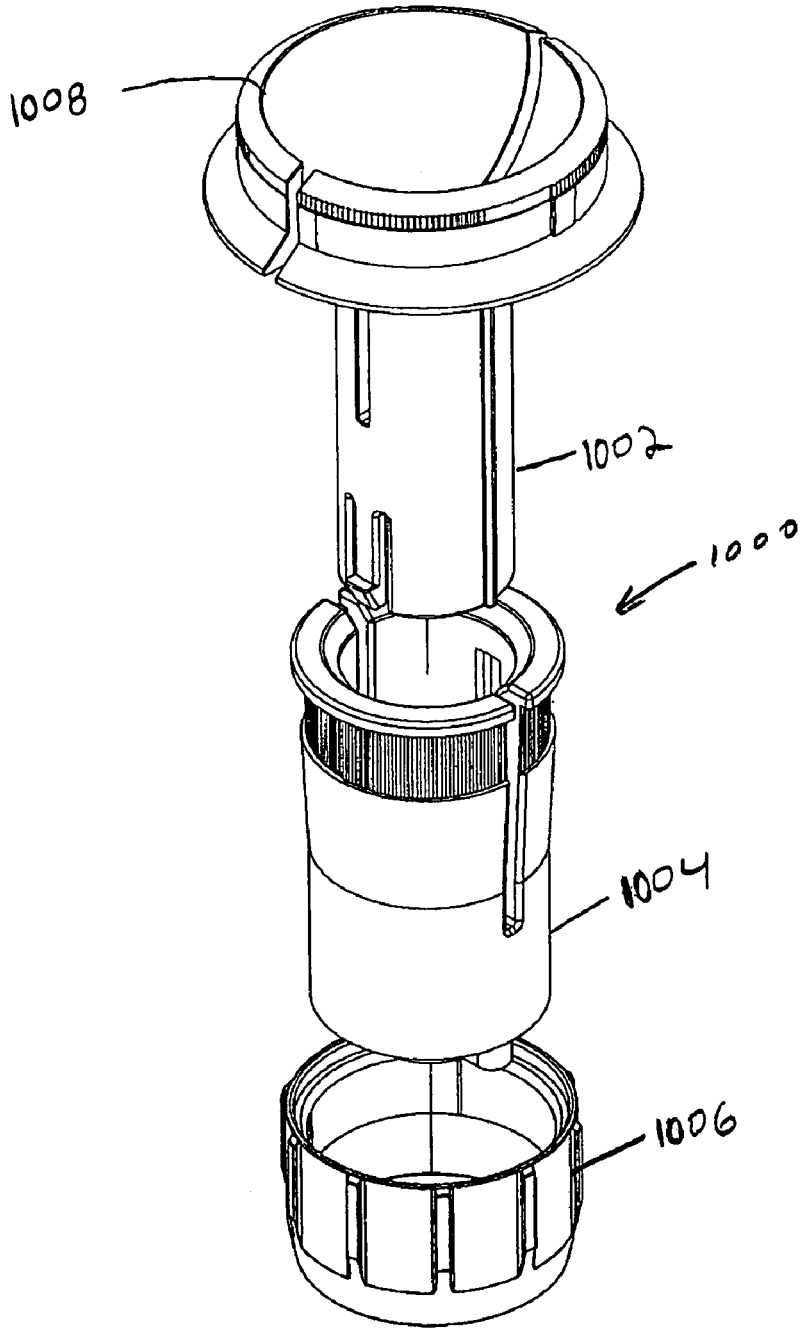
FIG. 10 illustrates an extension post mechanism according to one embodiment of the invention.

FIG. 10 illustrates an extension post mechanism 1000 according to one embodiment of the invention. The extension post mechanism 1000 includes an extendable inner post 1002, an outer post sleeve 1004, and a post lock ring 1006. The extendable post 1002 may include a mounting socket 1008 which may serve as a mechanical interface between an angling system to mount a ball-joint mechanism for securing an audio device (e.g., tweeter). The extendable inner post 1002 is sized to slide within the outer post sleeve 1004. This permits an installer to set the depth of the audio device by adjusting the position of the telescoping or extendable inner post 1002 relative to the outer post sleeve 1004. The outer post sleeve 1004 serves as the primary mechanical interface between the audio device (e.g., tweeter system) and the rest of the speaker system. The post lock ring 1006 is sized to slide snuggly around the outer post sleeve 1004 to lock the extendable inner post 1002 in place.

The extendable inner post 1002 and the outer post sleeve 1004 may be configured in a piston/cylinder arrangement that enables the extendable inner post 1002 to slide up and down inside the outer post sleeve 1004. According to one embodiment of the invention, the amount by which the inner post 1002 may extend depends on the length of the inner post 1002 and/or outer post sleeve 1004. For instance, in one implementation of the invention, the amount of travel allowed is sufficient to extend an audio device (e.g., tweeter) mounted on the mounting socket 1008 just below the ceiling's surface (e.g., approximately one inch) and enable "direct-axis" sound propagation to a listener positioned at an angle to the speaker system. A small amount of extension minimizes the effect on ceiling aesthetics that a non-flush grille may have. That is, by minimizing the amount by which the audio device (e.g., tweeter) protrudes beyond the surface of the ceiling, the effect of a non-flush surface is minimized.

Figure 11:
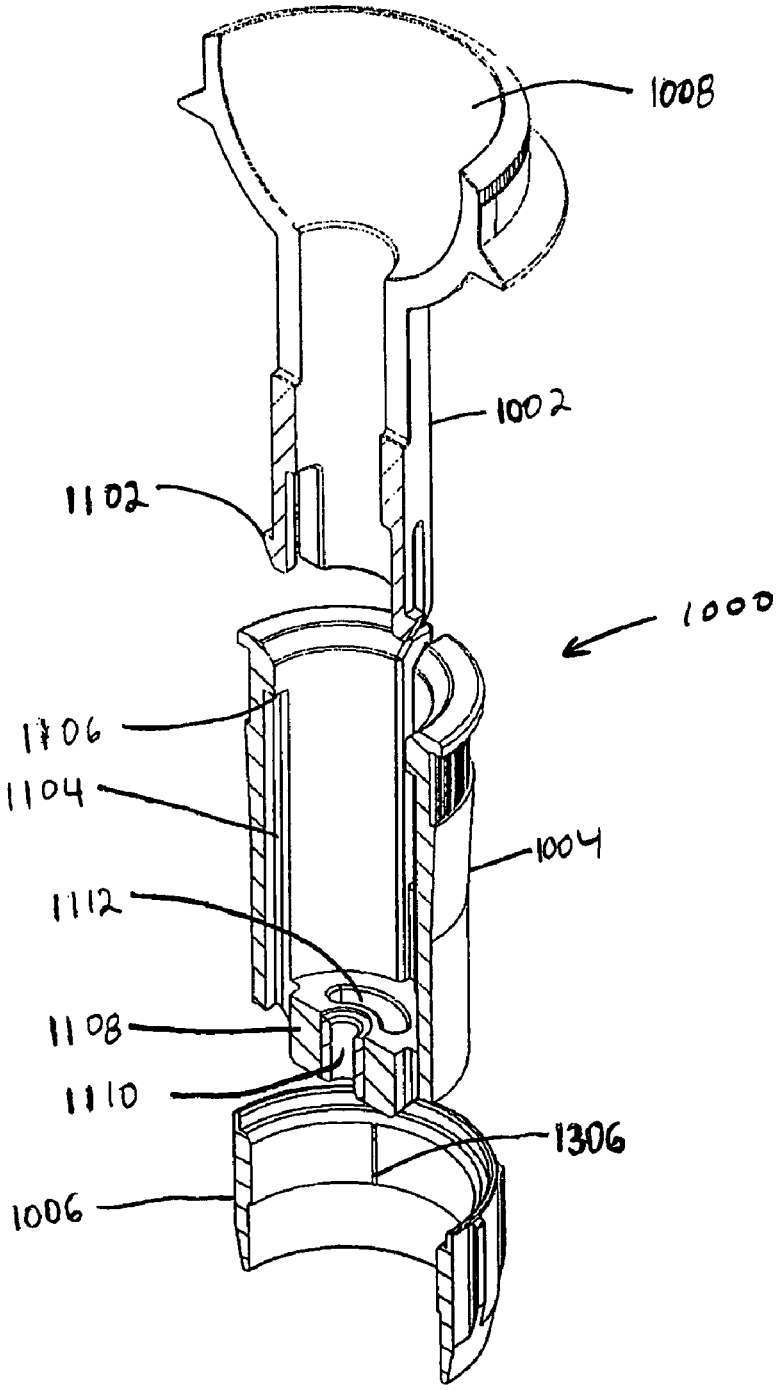
FIG. 11 illustrates a sectional view of the extension post mechanism illustrated in FIG. 1 according to one implementation of the invention.

FIG. 11 illustrates a sectional view of the extension post mechanism 1000 illustrated in FIG. 10 according to one embodiment of the invention. One aspect of the extension post mechanism 1000 may include one or more retention snap pins 1102 as part of the extendable inner post 1002 feature to secure the inner post 1002 to the outer post sleeve 1004. The outer post sleeve 1004 includes corresponding retention slots 1104 and retention stop 1106. The retention snap pins 1102 slide within the retention slots 1104 and are stopped by the retention stops 1106 once a maximum extension has been reached. This prevents the inner post 1002 from separating from the outer post sleeve 1004 when the lock ring 1006 is loosened.

The outer post sleeve 1004 may also be configured to be attached to a mounting mechanism. For instance, the outer post sleeve 1004 may include a base 1108 with an opening 1110 which can serve to fasten the outer post sleeve to a mounting mechanism. In one implementation of the invention, the opening 1110 may be threaded to be screwed on a fastener. Alternatively, the opening 1110 may receive a threaded fitting which can be screwed on a fastener. In another embodiment of the invention, other fastening systems or mechanism may be used to couple the outer post sleeve 1004 to a mounting mechanism without departing from the invention.

The base 1108 may also include a second opening 1112 that may serve as a passage to electrically conductive wires. For instance, the second opening 1112 may permit electrical wires to run from through the outer post sleeve 1004 and inner post 1002 to an audio device mounted on the socket 1008.

Figure 12:
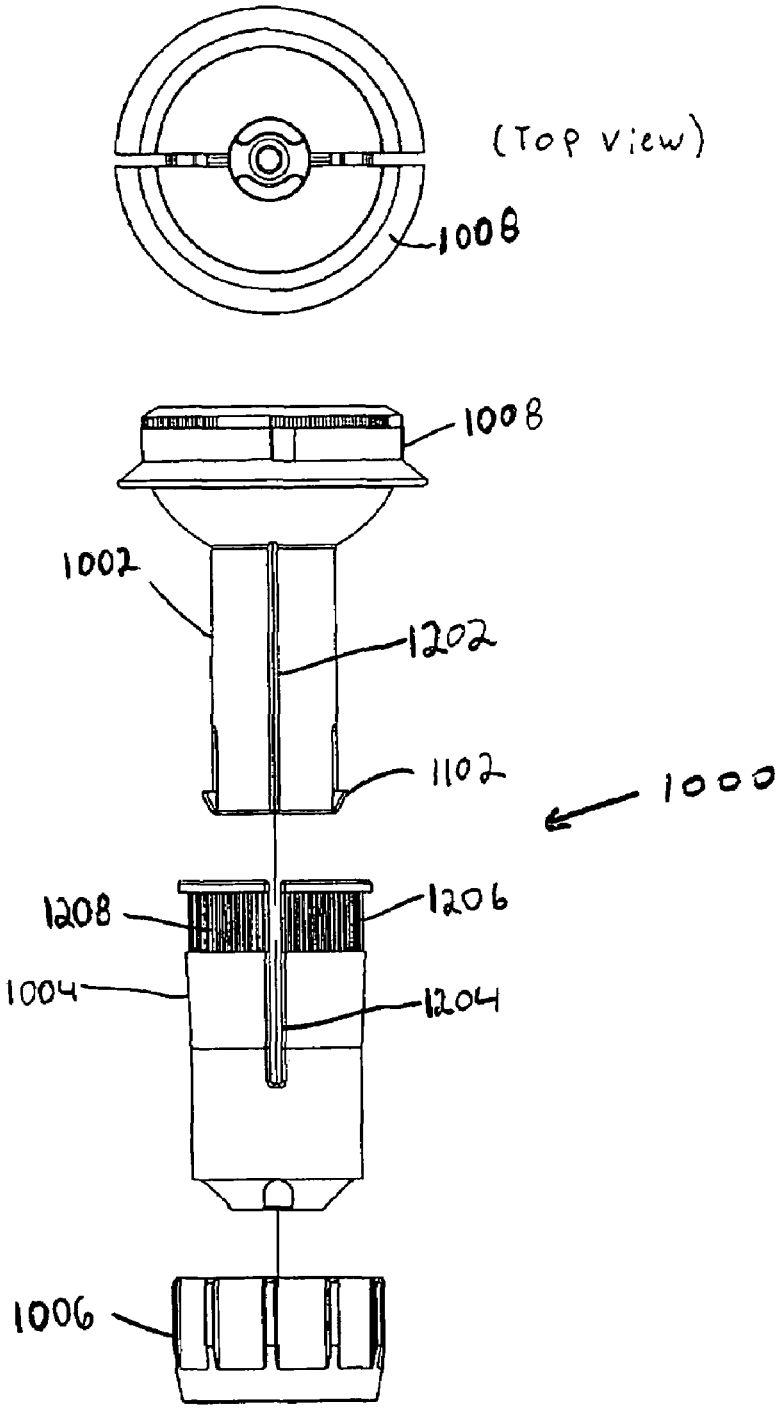
FIG. 12 illustrates a side view of the extension post mechanism illustrated in FIG. 1 according to one implementation of the invention.

FIG. 12 illustrates a side view of the extension post mechanism 1000 illustrated in FIG. 10 according to one embodiment of the invention. The extendable inner post 1002 includes one or more anti-rotation ribs 1202 which engage matching slots 1204 in the outer post sleeve 1004. While the anti-rotation ribs 1202 may slide up or down within the slots 1204, they restrict the rotation of the anti-rotation ribs 1202. This prevents the unintended rotation of the extendable inner post 1002 relative to the outer post sleeve 1004.

The extendable inner post 1002 may be secured at a desired position by tightening the post lock ring 1006 around the upper neck 1206 of the outer post sleeve 1004. According to one aspect of the invention, the post lock ring 1006 and outer post sleeve 1004 include a ramp locking mechanism to tighten the lock ring 1006 around the outer post sleeve neck 1206 thereby securing the position of the inner post 1002 relative to the outer post sleeve 1004.

Figure 13:
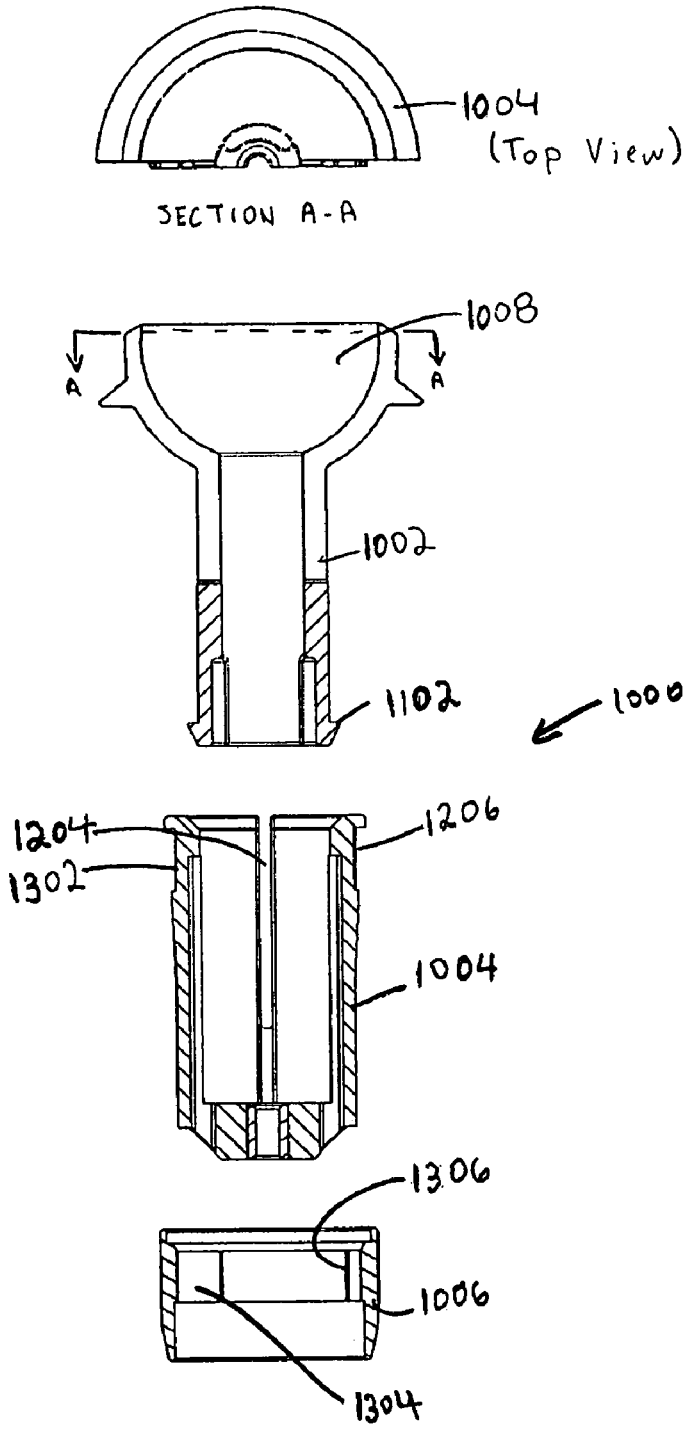
FIG. 13 illustrates a sectional view of the extension post mechanism illustrated in FIG. 1 according to one implementation of the invention.

FIG. 13 illustrates a sectional view of the extension post mechanism 1000 of FIG. 10 according to one embodiment of the invention. The outer post sleeve 1004 includes a retention slot 1302 around the neck 1206. The retention slot 1302 also includes one or more ramps which gradually vary the diameter of the neck 1206. That is, the retention slot 1302 is not perfectly circular but rather includes portions around the retention slot 1302 that gradually increase in diameter. These ramps serve to tighten the outer sleeve 1004 around the inner post 1002 when the lock ring 1006 is rotated. The diameter of the outer sleeve neck 1206 is allowed to tighten by the inward radial force exerted by the lock ring 1006 and the slots 1204 which permit the outer sleeve walls to flex inward.

The lock ring 1006 includes an internal retention ring 1304 that fits into the retention slot 1302. The lock ring 1006 also includes one or more protruding tensioning ribs 1306 that slide against the tensioning ramps of the retention slot 1302 to gradually increase the inward force exerted on the neck 1206 of the outer sleeve 1004. Once the lock ring 1006 is tightened around the neck of the outer sleeve 1004, loosening of the lock ring 1006 is prevented by a plurality of tensioning lines or bumps 1208 in FIG. 12 which create friction with the tensioning ribs 1306.

Another aspect of the invention provides a method for angling an audio device (e.g., tweeter) that may be coupled to the socket 1008, relative to its mounting 1000, in such a way that it may be infinitely adjustable between its un-angled position, and a maximum angle (e.g., up to fifty degrees (50°)).

In various embodiments of the invention, the extension post mechanism may be: a post that telescopes or adjusts its length by having two posts move longitudinally relative to each other to increase or decrease the overall length of the extension post mechanism, a post that may have a fixed length but can be retracted or extended relative to a reference point (e.g., a mounting surface, etc.), or any other mechanism that can be extended or retracted to place an audio device at a first side of the mounting surface, flush with the mounting surface, or on a second side of the mounting surface.

Figure 14:
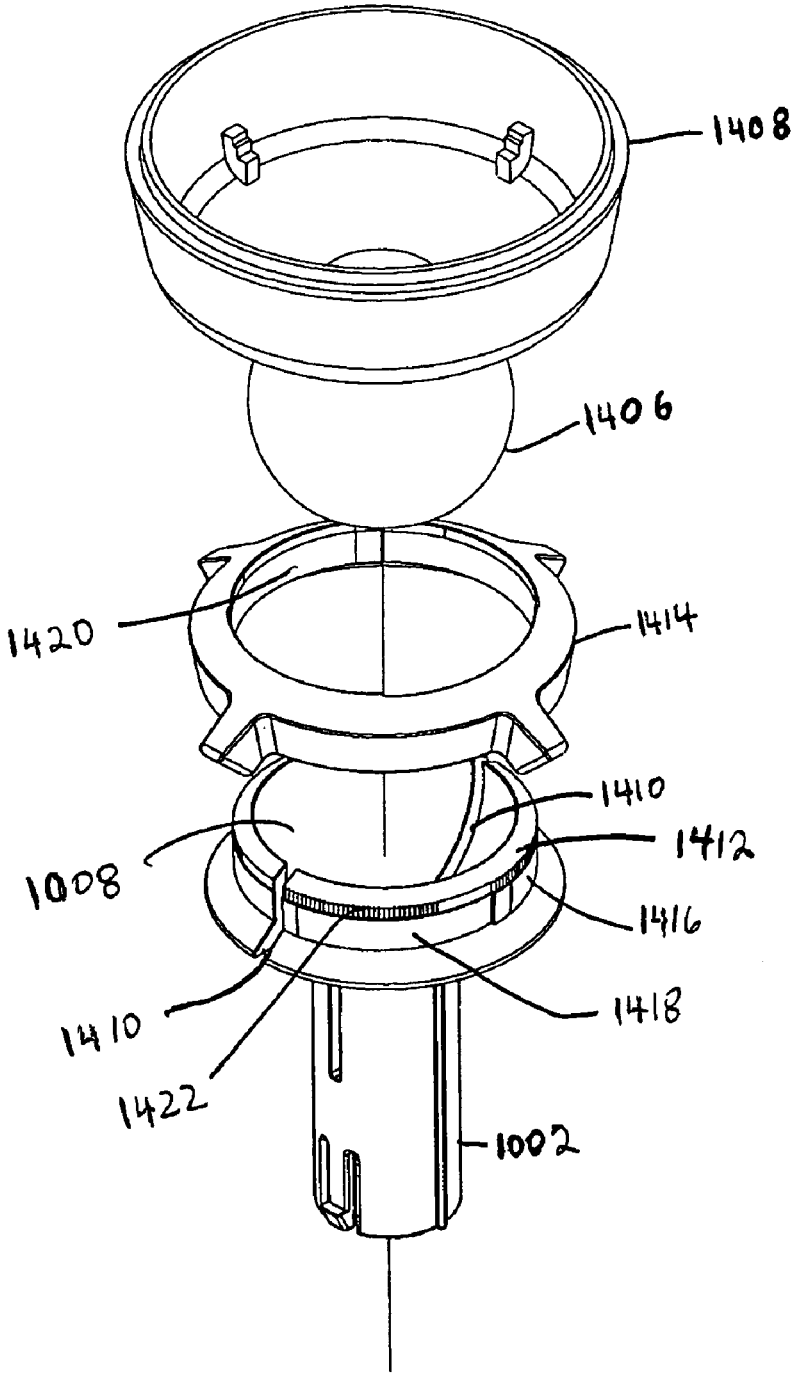
FIG. 14 illustrates a retaining and angling mechanism that may operate with an extension post mechanism according to one implementation of the invention.

FIG. 14 illustrates a retaining and angling mechanism that may operate with an extension post mechanism according to one implementation of the invention. One embodiment of the retaining and angling mechanism includes an extendable post 1002 having a receiving socket 1008, a rotating ball 1406 that sits on the socket 1008 in a ball-joint configuration, a device housing 1408 that is coupled to the rotating ball 1406 and a lock ring 1414 to secure the rotating ball 1406 to the socket 1008.

According to one implementation of the invention, the socket 1008 includes grooves or split lines 1410 that permit it to expand and/or contract around the rotating ball 1406. That is, the socket walls or edges 1412 can flex outward when the rotating ball 1406 is inserted or flex inward when the lock ring

1414 is secured around the socket edge 1412. In one implementation of the invention, the grooves or split lines 1410 extend to the inner post 1002.

The socket 1008 has a depth that is slightly more than the radius of the rotating ball 1406. The rotating ball 1406 may be pressed into the socket 1008 so that its midpoint sits just below the socket edge 1412. That is, the circumference of the rotating ball 1406 within the socket 1008 is larger than the circumference of the rotating ball outside of the socket 1008. Thus, when an inward radial force is exerted around the socket edge 1412, the rotating ball 1406 is rotationally secured within the socket 1008.

Once the rotating ball 1406 is inserted into the socket 1008 the lock ring 1414 is slid over the socket 1404 to rotationally secure the rotating ball 1406.

Figure 15:
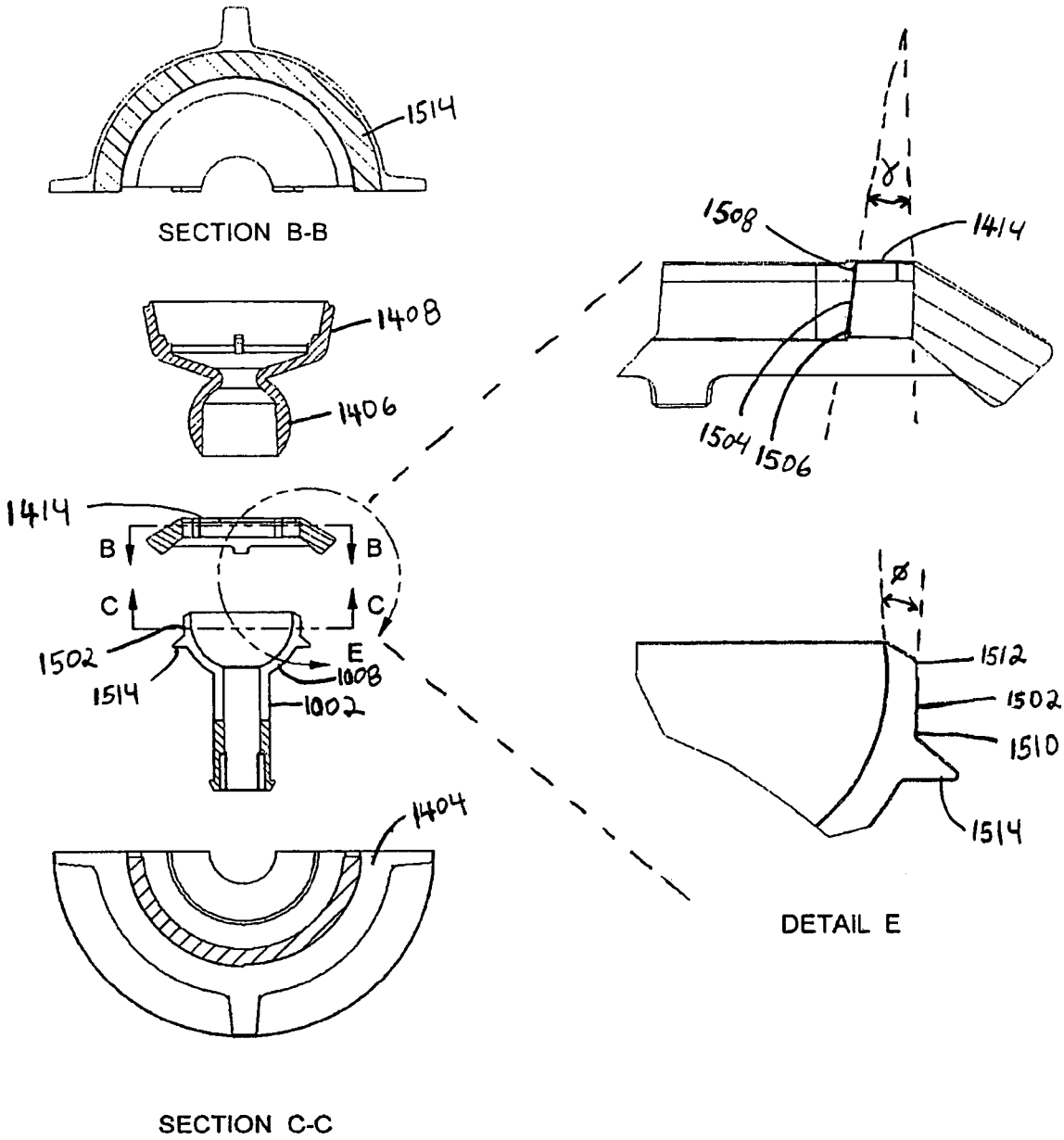
FIG. 15 is a sectional view of the retaining and angling mechanism in FIG. 14 according to one embodiment of the invention.

FIG. 15 is a sectional view of the retaining and angling mechanism in FIG. 14 according to one embodiment of the invention. In one implementation of the invention, a reverse angle retention arrangement is used to secure the lock ring 1414 around the socket neck 1502. Such reverse angle retention system may be implemented by angling the interior wall 1504 of the lock ring 1414 outward as shown and angling the exterior wall of the socket neck 1502 outward as shown. In particular, the diameter of the lower ring interior ring lock 1506 may be slightly smaller than the diameter of the upper interior lock ring 1508. Similarly, the diameter of the lower socket neck 1510 may be smaller than the diameter of the upper socket neck 1512. By making the diameter of the lower inner ring lock 1506 smaller than the diameter of the upper socket neck 1512, the lock ring is prevented from sliding off the socket neck 1502. Since the walls of the socket 1008 flex inwards and outwards, the smaller diameter of the inner ring lock 1506 can be pressed passed the larger diameter of the upper socket neck 1512.

The retention effect of the reverse angle retention system described above may be further improved by using tensioning ramps to tighten the rotating the lock ring 1414 around the socket neck 1502. According to one implementation of the invention, tension ramps 1416 and 1418 are formed along the circumference of the socket neck 1502. Similar ramps are formed along the inner circumference of the lock ring 1414. These tensioning ramps 1416 and 1420 are mating in nature, as the lock ring 1414 is rotated (e.g., clockwise), they apply an inward force to the socket neck 1502 which in turn applies an equal inward radial force upon the rotating ball 1406. The inward radial force upon the rotating ball 1406 ensures the retention of the rotating ball 1406 in the socket 1008, regardless of the ball's 1406 rotational position.

Figure 16:
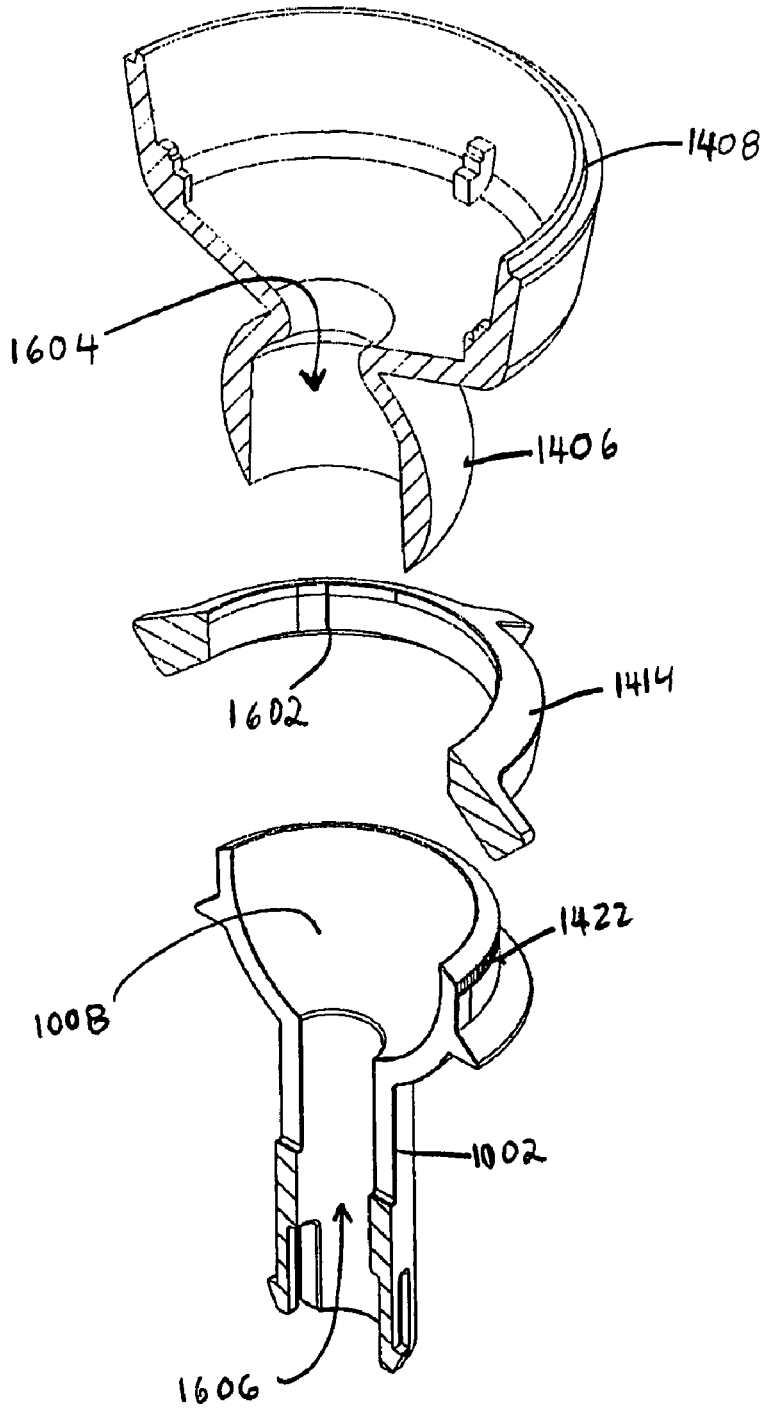
FIG. 16 illustrates a perspective sectional view of the reverse angle retention system of FIG. 14 according to one implementation of the invention.

FIG. 16 illustrates a perspective sectional view of the reverse angle retention system of FIG. 14 according to one implementation of the invention. The lock ring's 1414 locking position is maintained by the interaction between lock ring tensioning ribs 1602 and socket neck bumps 1422.

According to one implementation of the reverse angle retention system, the socket 1008 includes a ledge or tabs 1514 along the outer surface of the socket 1008 that stop the lock ring 1414 from going past a desired position on the socket neck 1502.

Another aspect of the invention provides a plurality of passages through which to pass wires to and/from an audio device mounted on the device housing 1408. The device housing 1408 and rotating ball 1406 may define an opening 1604 through which one or more wires may pass. Additionally, the extendable inner post 1002 and socket 1008 also define a passage 1606 through which wires may pass to passage 1604. In this manner, an audio device mounted on the device housing 1408 may be electrically coupled to other devices.

When placed in the socket 1008, the rotating ball 1406 may be angled to a desired position. For instance, according to one implementation of the invention, the rotating ball may be angled up to fifty degrees relative to the extension mechanism 1000. The rotating ball 1406 may have a passage 1604 with a sufficiently large opening such that, when the rotating ball is angled relative to the extension mechanism 1000, the wires to the audio device passing through the passage 1604 permit the rotating ball to angle up to fifty degrees.

In concert with the post extension mechanism, these features enable the placement of an in-wall or in-ceiling audio device (e.g., speaker, woofer, tweeter, audio transducer, etc.) in such a way so as to place the listener in a "direct on-axis" position with the audio device, even when the listener is listening from the opposite end of a room relative to the speakers mounting position. That is, by placing the audio device just below the surface of the ceiling and/or angling the audio device sufficiently, the sound dispersion axis of the audio device may reach a listener directly for better sound perception.

Referring again to FIG. 9, a cross-sectional view of an audio device implementing an extendable post and angling system according to one embodiment of the invention is illustrated. A speaker device 922 may be mounted on a frame assembly 902. A sub-woofer 926 may be mounted on an extendable post system 1002, 1004, and 1006 (also illustrated in FIGS. 10-13) and on an angling socket assembly 1008, 1406, 1408, and 1414 (also illustrated in FIGS. 14-16).

As discussed above with reference to FIGS. 1-9, a first audio device 922 may be mounted in the frame assembly 902 in an angling mechanism that permits to direct the sound dispersion axis of the first audio device 922 in a desired direction.

According to one embodiment of the invention, the extendable post system 1002, 1004, and 1006 may be mounted substantially at or through the center of the first audio device 922. This setup permits mounting two or more audio devices 922 and 926 on a single frame assembly 902 or device housing. As discussed above with reference to FIGS. 10-16, the extendable post 1002 and angling mechanism permit mounting a second audio device 926 in the same frame assembly 902. The extendable post system 1002 may be adjusted to position the second audio device 926 either above, flush with, or below the mounting surface as desired. The angling system 1008, 1406, 1414 permits directing the sound dispersion axis of the second audio device 926 in a desired direction.

Figure 17:
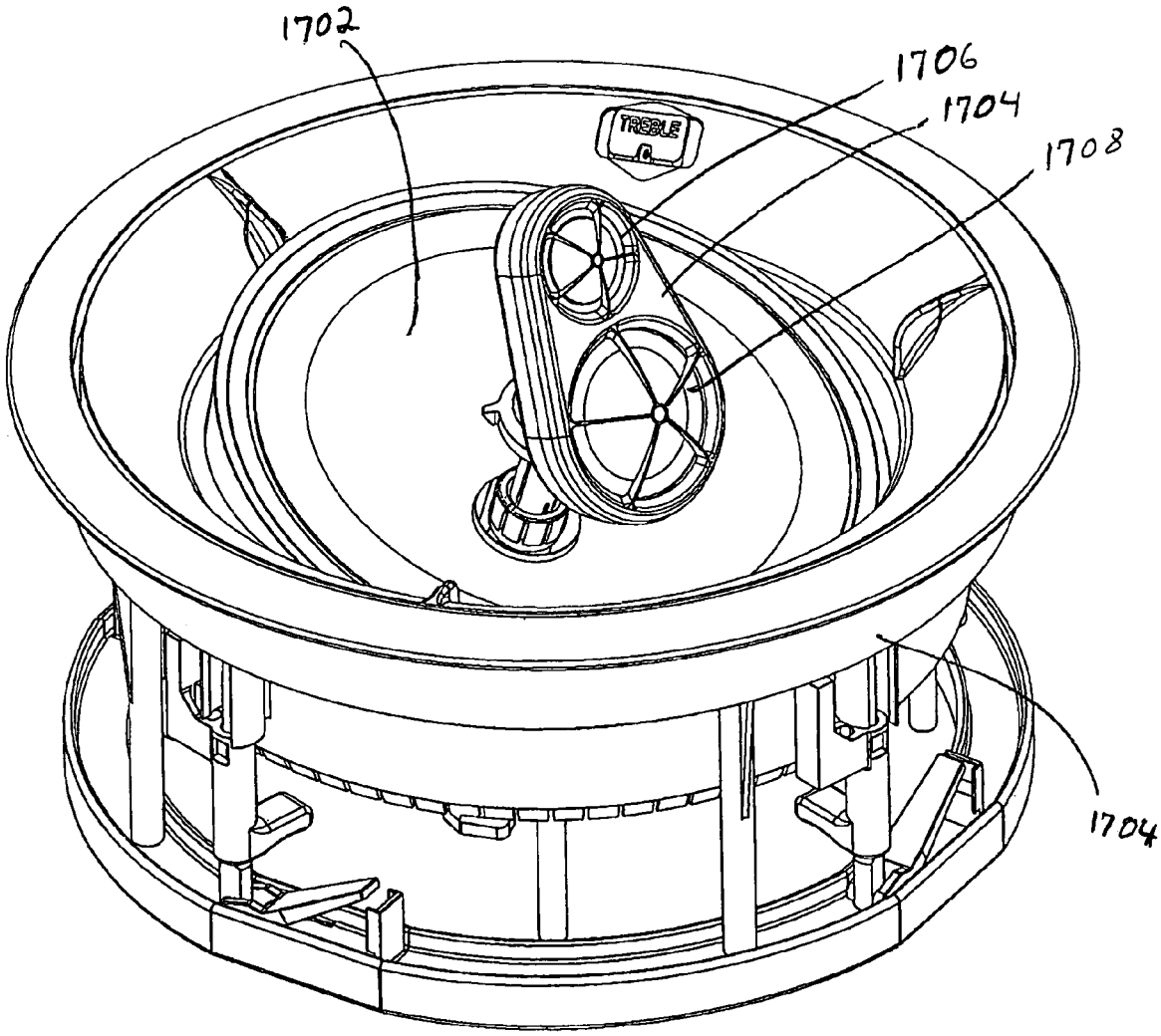
FIG. 17 illustrates a perspective view of an audio device having an extension post and the retaining and angling mechanism to hold two or more audio transducer devices according to one embodiment of the invention.

FIG. 17 illustrates a perspective view of an audio device system having an extension post and the retaining and angling mechanism to hold two or more audio transducer devices according to one embodiment of the invention. The frame assembly 1704 may support an audio transducer device (e.g., speaker) 1702, at an adjustable angle, while the extension post 1002 and 1004 (FIGS. 10-13) and angling socket assembly 1008, 1406, 1408, and 1414 (FIGS. 14-16) may secure a multiple-transducer housing 1704. For example, the housing 1704 may hold a tweeter 1706 and sub-woofer 1708 in one implementation of the invention. Other types of transducer devices may also be held by the housing 1704. The housing 1704 and transducer devices 1706 and 1708 may be angled and position as desired to achieve a desirable sound dispersion.

FIGS. 18, 19, 20, and 21 illustrate a recessed speaker assembly 1800 having the extension post mechanism of FIGS. 10-13 and the angling mechanism of FIGS. 14-16 according to one embodiment of the invention. The recessed speaker assembly 1800 is mounted inside an opening in a ceiling, wall, or other surface 1801 with the exposed face trim 1806 sitting substantially flush with the mounting surface 1801. One or more audio devices 1802 and 1808 may be mounted within the recessed speaker assembly. For example, a first audio device 1808 may be a speaker or woofer, and a second audio device 1802 may be a tweeter, mid-range speaker, and/or sub-woofer.

The first audio device 1808 may be supported by a rotating angling system 1810. The second audio device 1802 may be supported on a ball-and-socket angling system 1810 that is coupled to the telescoping post mechanism 1804. This permits independent adjustment of the position and/or angle of the second audio device 1802 relative to the first audio device 1808.

Figure 18:
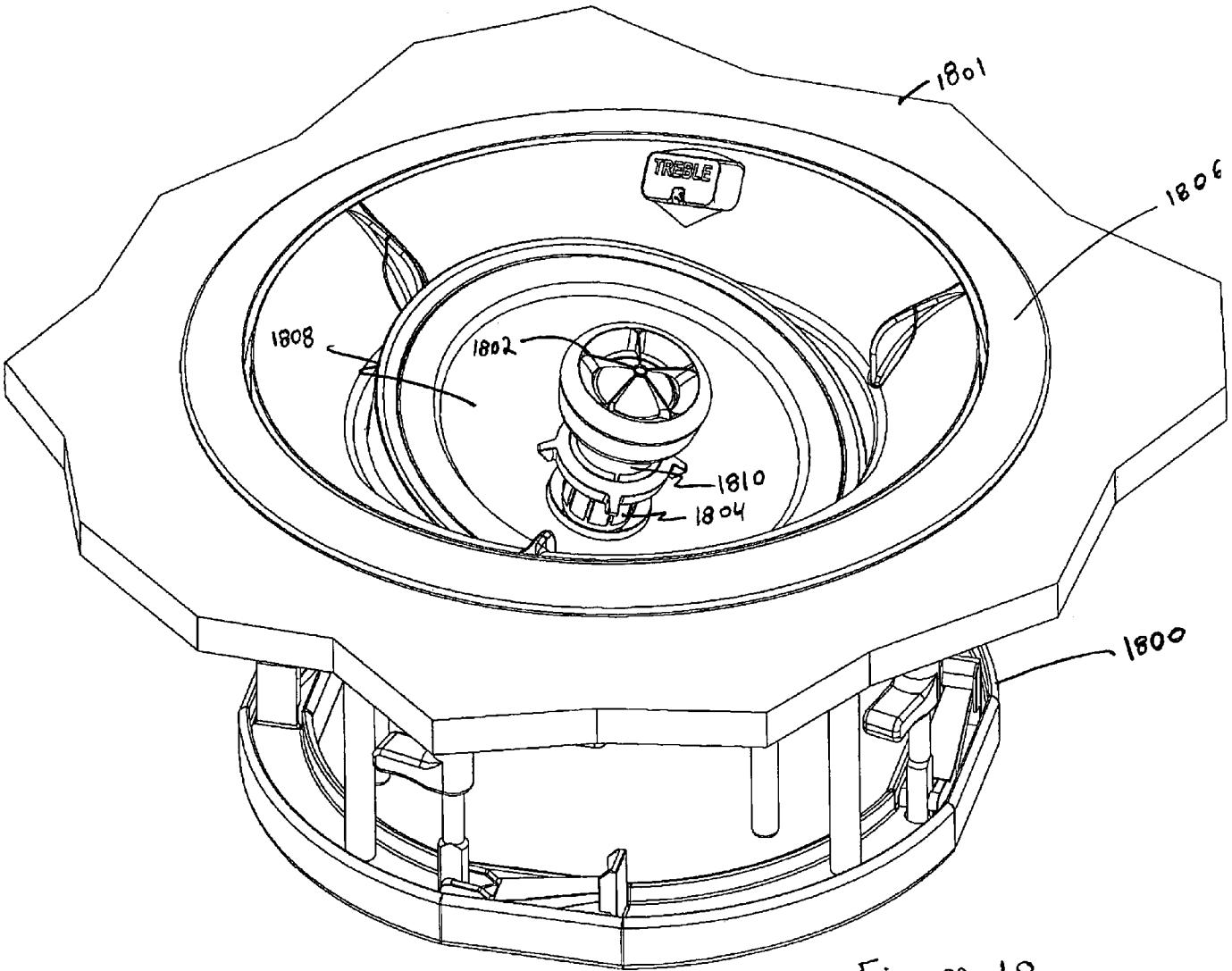
FIGS. 18, 19, 20, and 21 illustrate a recessed speaker assembly having the extension post mechanism of FIGS. 10-13 and the angling mechanism of FIGS. 14-16 for a single audio device according to one embodiment of the invention.
Figure 19:
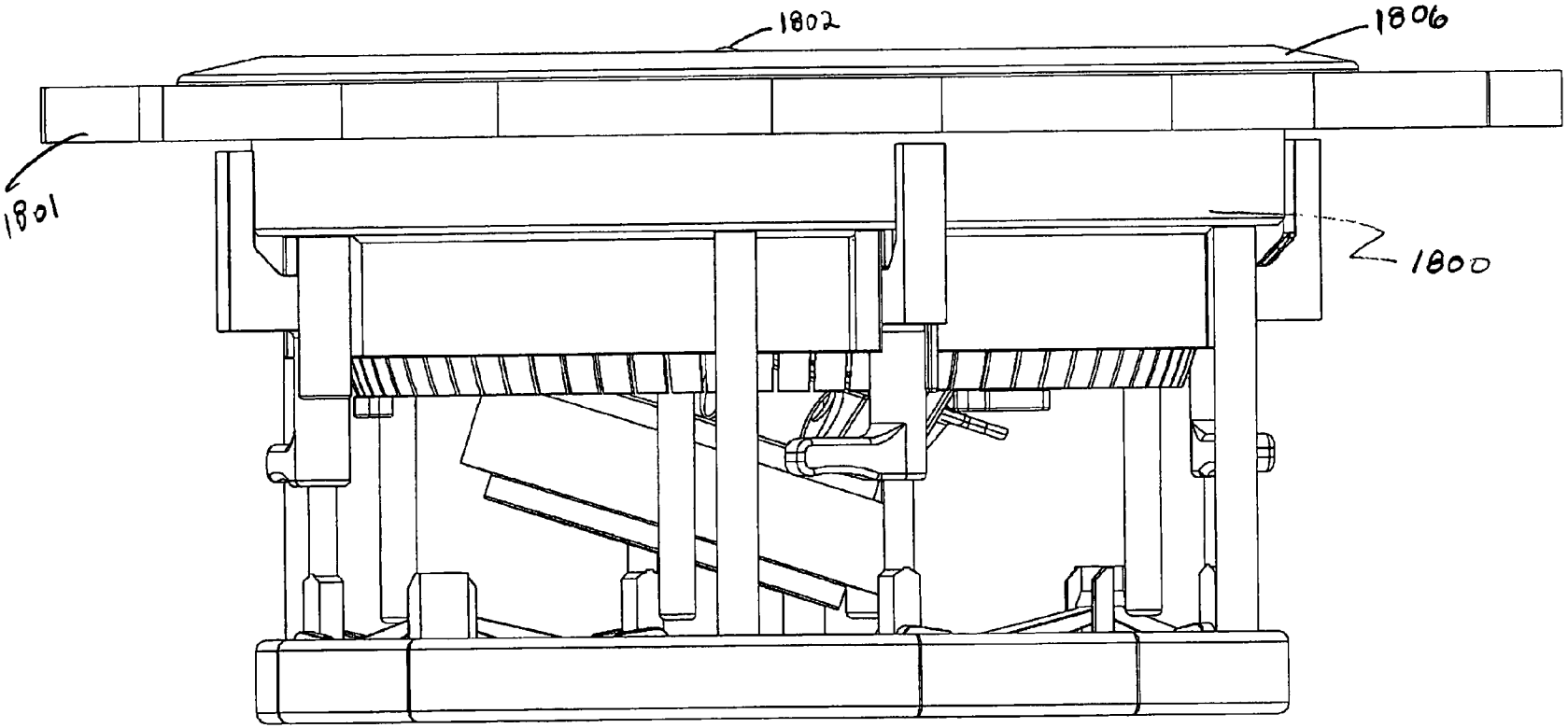

FIGS. 18 and 19 illustrate the telescoping post mechanism 1804 in a retracted position. As seen in the side view of FIG. 19, when the telescoping post mechanism 1804 is in a retracted position, the audio device 1802 mounted thereon is positioned at or below the plane defined by the mounting surface 1801 (e.g., wall or ceiling) in which the speaker assembly 1800 is mounted. That is, the retracted telescoping post mechanism 1804 places the audio device 1802 below or substantially flush with the mounting surface 1801.

Figure 20:
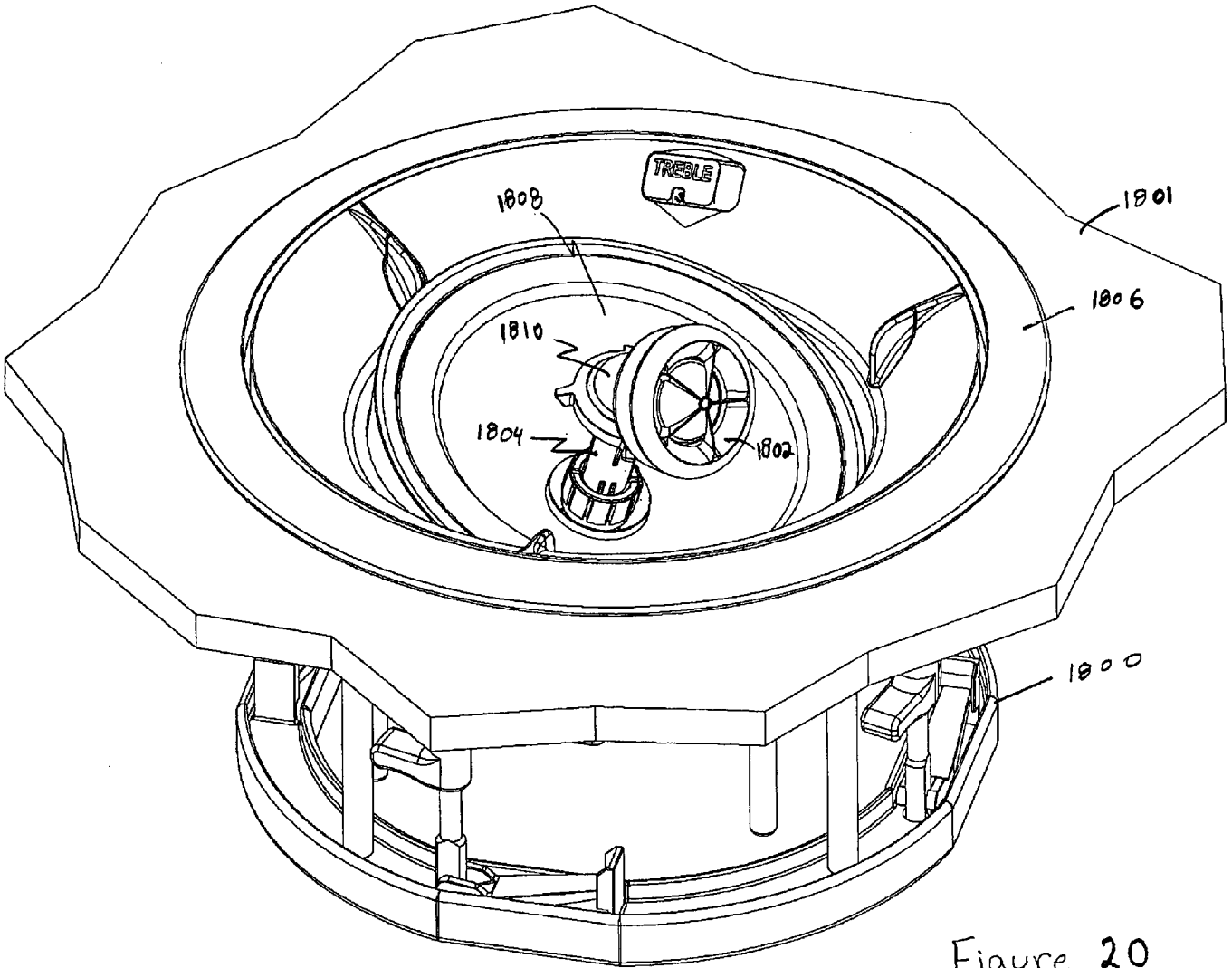
Figure 21:
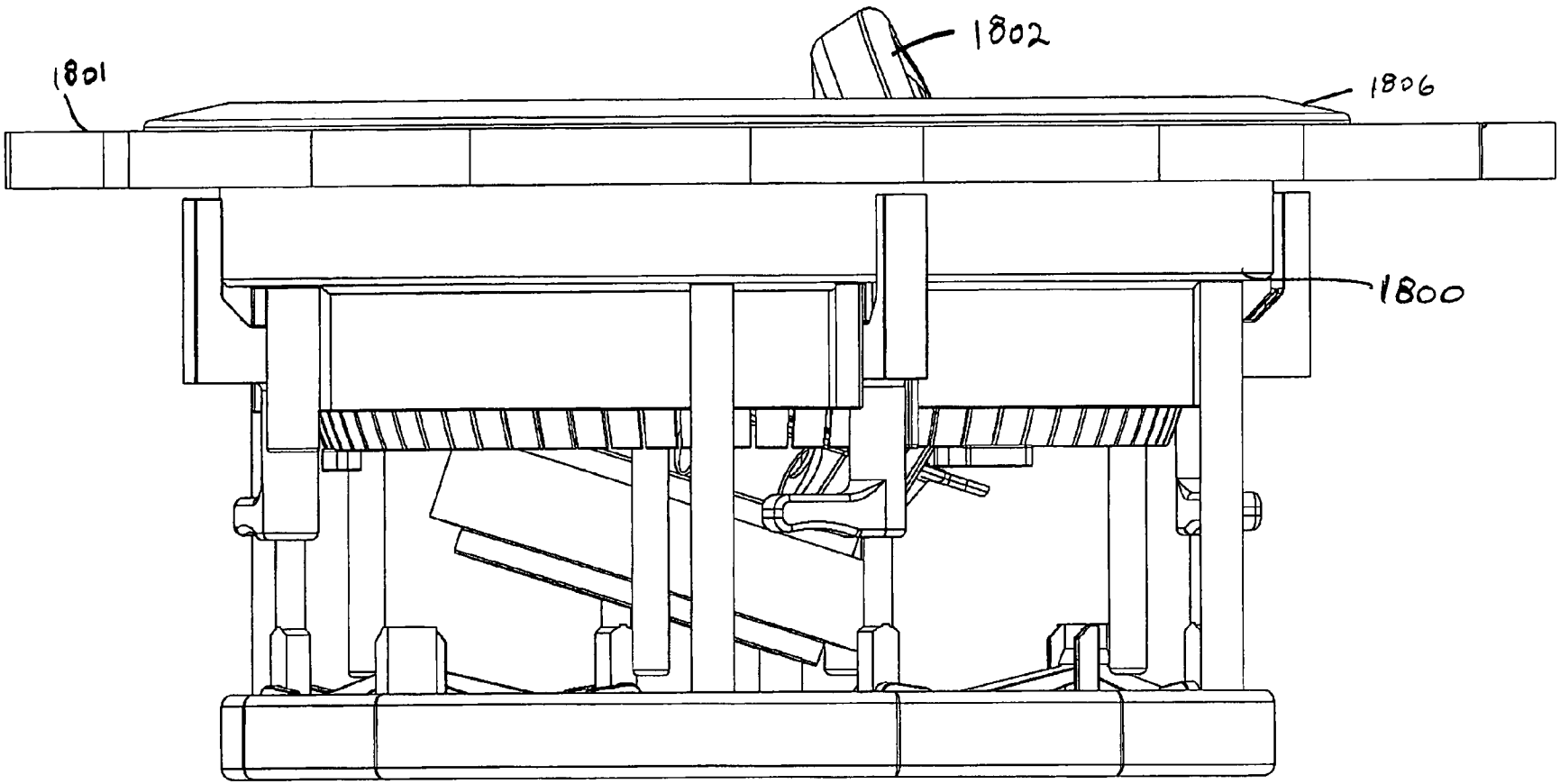

FIGS. 20 and 21 illustrate the telescoping post mechanism 1804 in an extended position. The telescoping post 1804 has been extended outwards to position the audio device 1802 above the mounting surface 1801. That is, the audio device 1802 is positioned so that it protrudes partially (e.g., one inch) or totally beyond the mounting surface 1801. The audio device 1802 may be also be angled to achieve a desired sound dispersion axis. For example, the speaker assembly 1800 may be mounted above the ceiling surface and the audio device 1802 can be extended below the ceiling surface and angled to a desired location. In this manner, the telescoping post mechanism 1804 and angling system 1810 permit the sound dispersion axis of the audio device 1802 to be directed to any desired location without obstruction or interference from the ceiling.

In other embodiments of the invention, other mechanisms that can be extended or retracted to place an audio device at a first side of the mounting surface (e.g., above the mounting surface), flush with the mounting surface, or on a second side of the mounting surface (e.g., below the mounting surface) may be employed without departing from the invention.

FIGS. 18-21 also illustrates the first audio device 1808 at an angle to the mounting surface 1801. The first audio device 1808 is mounted on a frame 104 (in FIG. 1) that rotates against the baffle 102. The telescoping post mechanism 1804 and angling system 1810 may be supported by the structure of the first audio device 1808 and/or the frame 104.

FIGS. 22, 23, 24, and 25 illustrate a recessed speaker assembly 1800 having the extension post mechanism 1804 of FIGS. 10-13 and the angling mechanism 1810 of FIGS. 14-16 for multiple audio devices 2204 and 2206 according to one embodiment of the invention. Instead of the single audio device housing of FIGS. 18-21, FIGS. 22-25 illustrate an example of a multiple device housing 2202 that may serve to house multiple audio devices 2204 and 2206 according to one embodiment of the invention. The multiple device housing 2202 includes a ball mounting to couple to the same or similar socket 1406 (FIG. 14) used by the single audio device housing illustrated in FIGS. 14-16.

The multiple device housing 2202 enables mounting more audio devices 2204 and 2206 in a single speaker location. For example, the multiple device housing 2202 can enable mounting two or more tweeters, mid-range speakers, and/or sub-woofers, or a combination thereof, on a single post extension 1804 and angling mechanism 1810.

Figure 22:
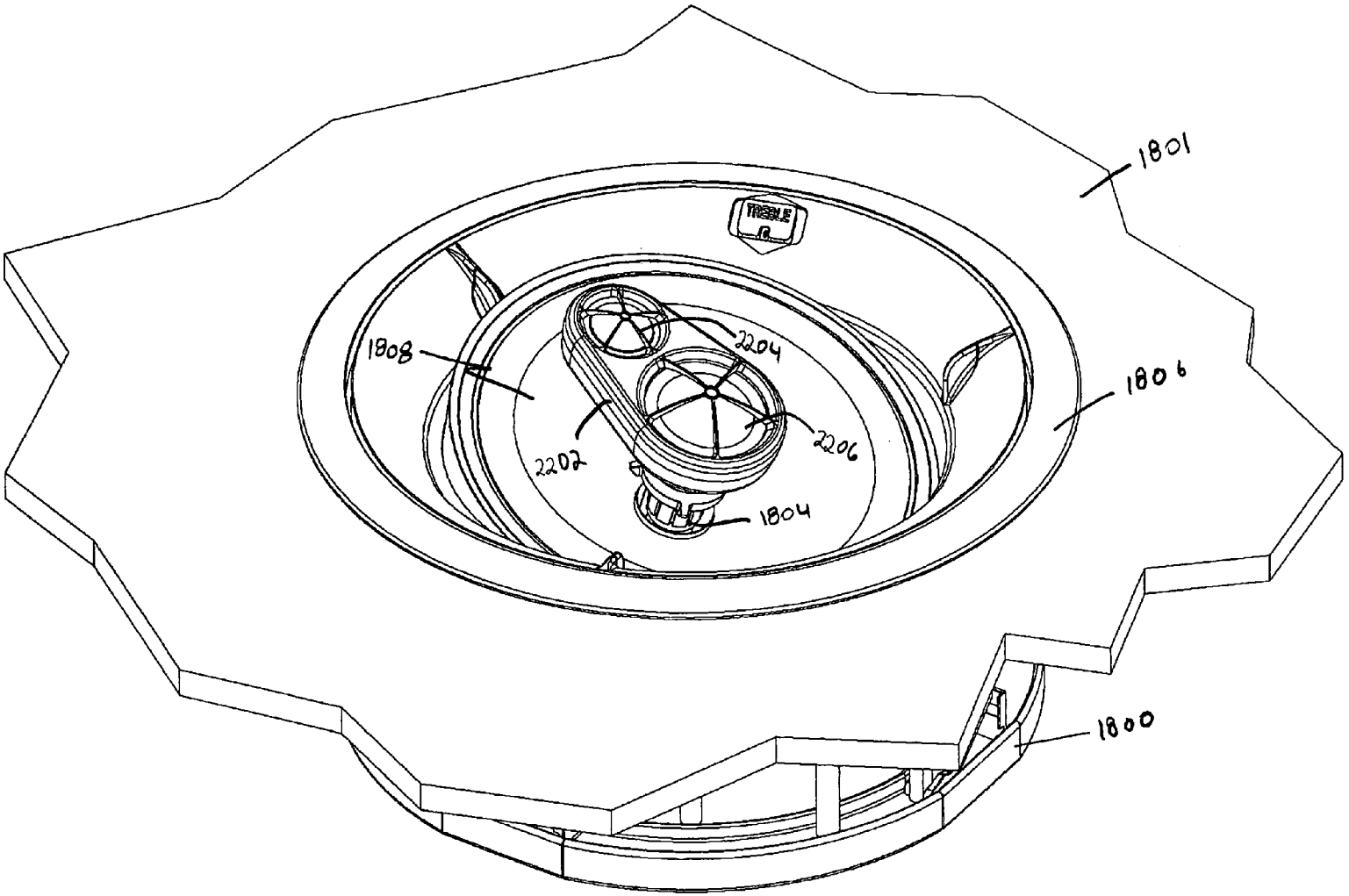
FIGS. 22, 23, 24, and 25 illustrate a recessed speaker assembly having the extension post mechanism of FIGS. 10-13 and the angling mechanism of FIGS. 14-16 for multiple audio devices according to one embodiment of the invention.
Figure 23:
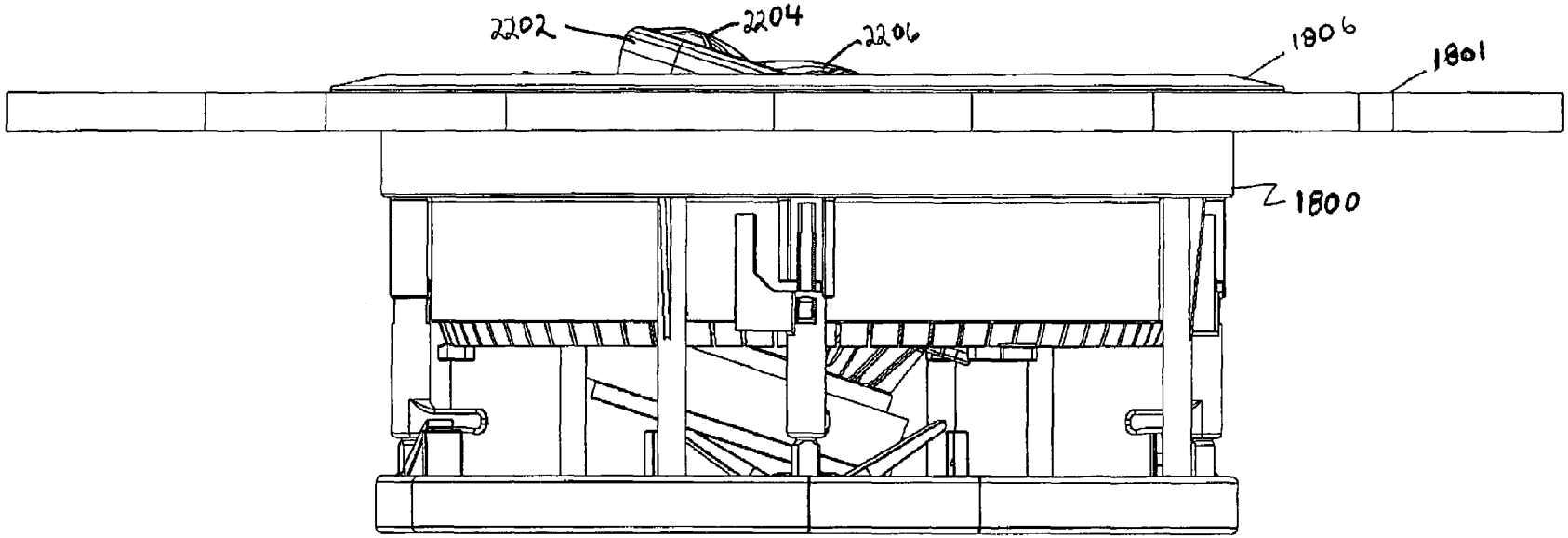

FIGS. 22 and 23 illustrate the speaker assembly 1800 in a substantially retracted position. That is, the telescoping post mechanism 1804 is minimized so that the audio device housing 2202 is positioned at, near, or below the plane defined by the mounting surface 1801 (e.g., wall or ceiling) in which the speaker assembly 1800 is mounted. That is, the retracted telescoping post mechanism 1804 places the audio device 1802 below or substantially flush with the mounting surface 1801. FIG. 23 illustrates a side view of the audio devices 2204 and 2206 positioned near the mounting surface 1801.

Figure 24:
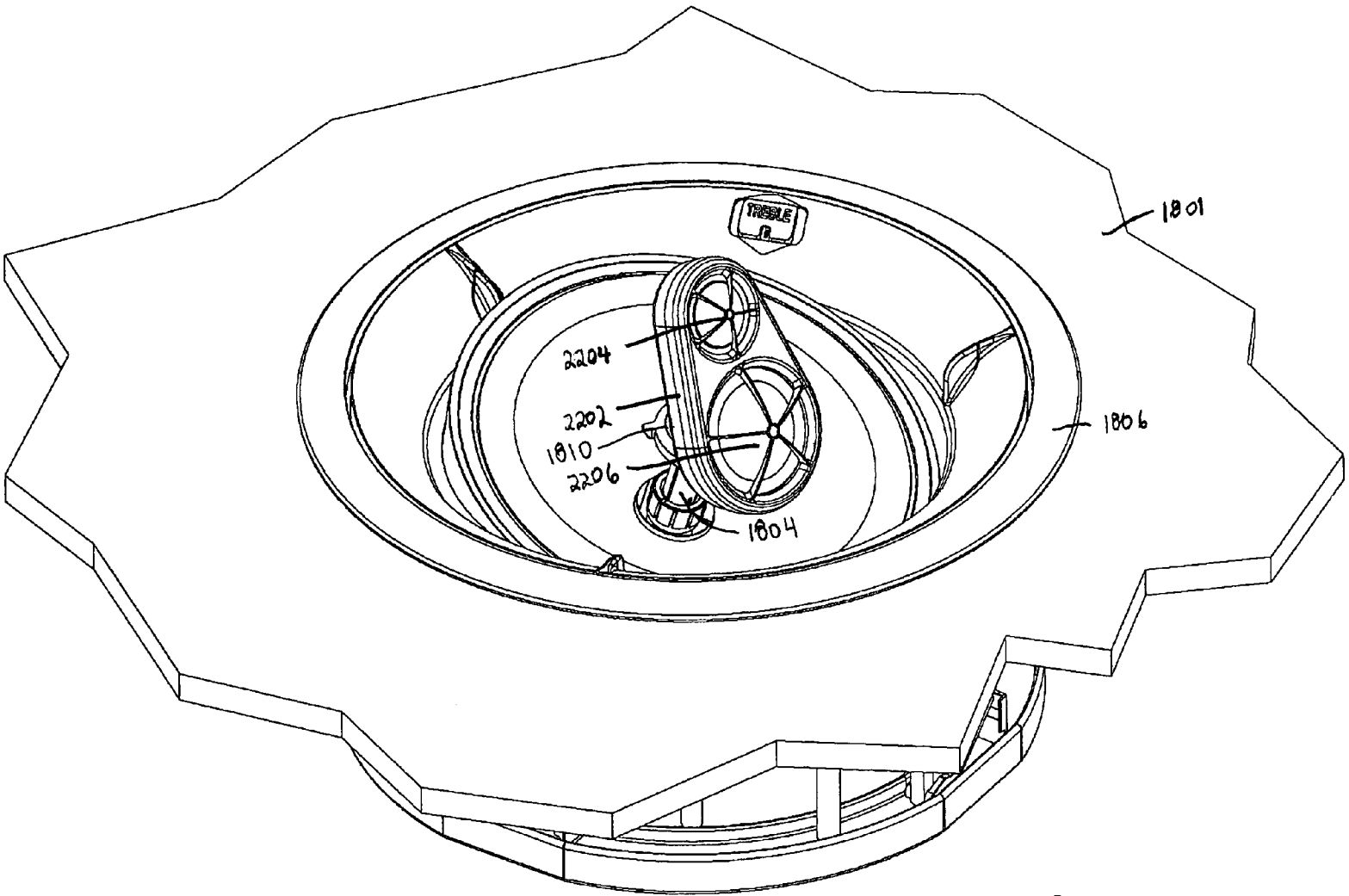
Figure 25:
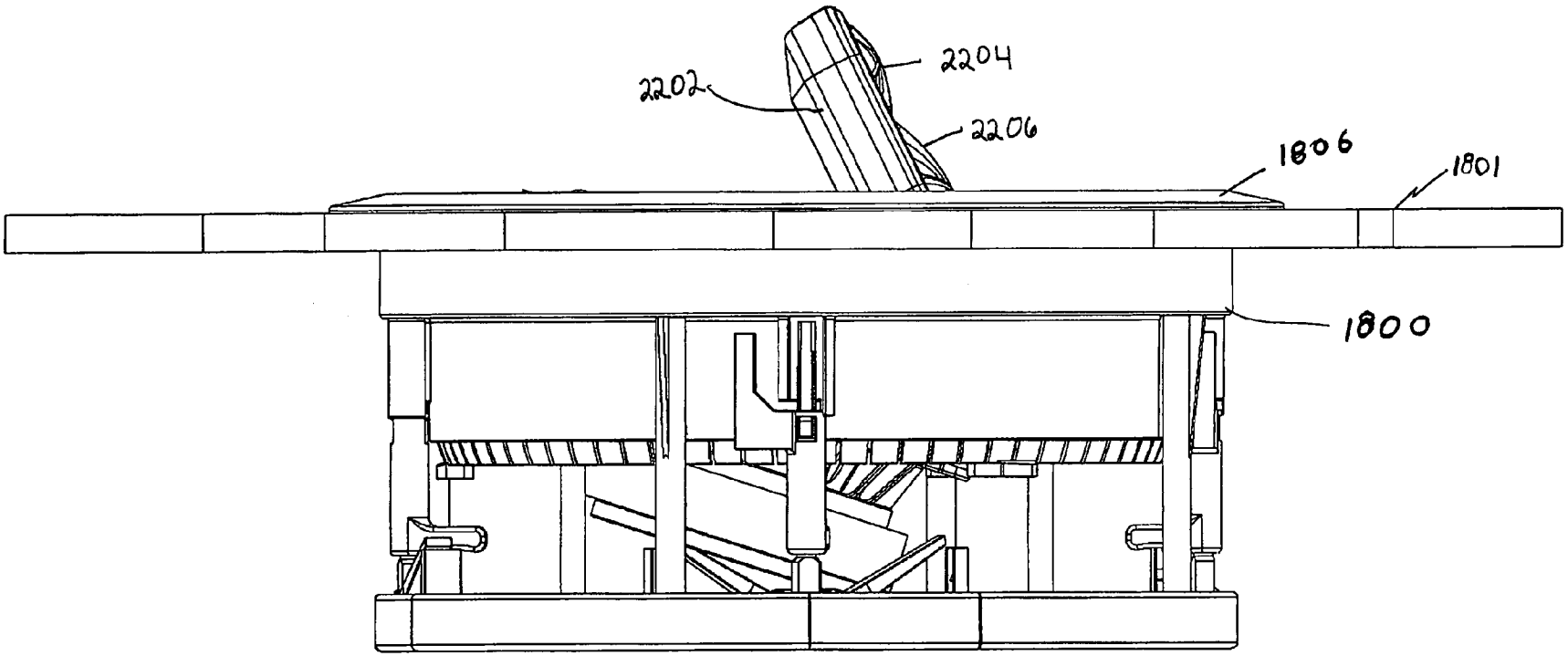

FIGS. 24 and 25 illustrate the telescoping post mechanism 1804 in an extended position with the angling system 1810 at an angled position. The telescoping post 1804 has been extended outwards to position the audio devices 2204 and 2206 above the mounting surface 1801. That is, the audio devices 2204 and 2206 are positioned so that they protrude partially (e.g., one inch) or totally beyond the mounting surface 1801. The audio devices 2204 and 2206 may be also be angled to achieve a desired sound dispersion axis. For example, the speaker assembly 1800 may be mounted above the ceiling surface and the audio devices 2204 and 2206 can be extended below the ceiling surface and angled to a desired location. In this manner, the telescoping post mechanism 1804 and angling system 1810 permit the sound dispersion axis of the audio devices 2204 and 2206 to be directed to any desired location without obstruction or interference from the ceiling.

The described telescoping post 1804 and angling system 1810 of the present invention can direct the sound dispersion axis of the audio devices as desired (e.g., without obstruction and/or interference from the mounting surface) while maintaining a low profile that is more aesthetically pleasing. For example, the audio devices may be positioned just below the ceiling surface, at a desired angle, so that they have a minimal effect on the aesthetics of the environment in which the recessed speaker mechanism is mounted.

Various embodiments of the invention may be implemented using parts, fasteners, frames, baffles, etc., constructed from one or more materials, or combination of material, including plastic, metal, polymers, and/or any other material.

The audio device(s) illustrated in FIGS. 1-25 may be installed by inserting an audio device housing or frame assembly into a recessed cavity so that the audio device housing is on a first side of a mounting surface. The audio device housing sits substantially flush with the mounting surface. The audio device housing is then secured in the recess cavity. The depth of a first audio device coupled to the audio device housing is adjusted so that the first audio is mounted either substantially flush with, or on a second side of, the mounting surface. The angle of the first audio device is then adjusted to direct its sound dispersion axis to a desired location. The angle of a second audio device coupled to the audio device housing is adjusted to direct its sound dispersion axis to a desired location. The angle of the second audio device being independently adjustable from the angle of the first audio device.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A device for recessed installations, comprising:

a housing configured to be installed on a first side of a mounting surface in a cavity opening defined by the mounting surface;

a first audio device mounted inside the housing, the first audio device positioned at the mounting surface or on the first side of the mounting surface;

an adjustable post coupled to the housing, the adjustable post including a first post and a second post that move relative to one another to increase or decrease the length of the adjustable post; and a second audio device coupled to the telescoping post such that it moves longitudinally with the adjustable post as the adjustable post length is increased or decreased; wherein the second audio device can be selectively positioned on the first side of the mounting surface, substantially flush with the mounting surface, and on a second side of the mounting surface by adjusting the length of the adjustable post.

2. The device of claim 1 further comprising:

an angling device coupled to the adjustable post and the second audio device to permit angling the second audio device to be directed along a desired sound dispersion axis.

3. The device of claim 2 wherein the angling device includes a ball-joint socket and ball coupler, wherein the ball coupler is sized to fit within the ball-joint socket, the ball coupler and ball-joint socket capable of rotating relative to each other, and a lock ring is sized to fit around the circumference of the ball-joint socket to tighten the ball-joint socket around the ball coupler, and wherein the ball-joint socket includes one or more tensioning ramps along circumference of the ball-joint socket, when the lock ring is rotated around the circumference of the ball-joint socket an inward radial force is exerted to secure the ball coupler at a particular position.

4. The device of claim 1 further comprising:

an angling mechanism coupled to the housing and the first audio device that permits angling the first audio device relative to the mounting surface.

5. The device of claim 1 further comprising:

a third audio device coupled to the telescoping post such that it can be positioned on the first side of the mounting surface, substantially flush with the mounting surface, and on the second side of the mounting surface by decreasing or increasing the length of the adjustable post.

6. The device of claim 1 wherein the adjustable post is mounted substantially at the center of the first audio device.

7. A device for recessed installations, comprising:

a housing configured for installation on a first side of a mounting surface in an opening defined by the mounting surface;

an adjustable post coupled to the housing; and a first audio device coupled to the adjustable post such that the first audio device can be selectively positioned on the first side of the mounting surface, substantially flush with the mounting surface, and on a second side of the mounting surface by adjusting the adjustable post.

8. The device of claim 7 wherein the first audio device can also be positioned on the first side of the mounting surface by adjusting the adjustable post.

9. The device of claim 7 wherein adjusting the adjustable post includes increasing or decreasing the length of the adjustable post.

10. The device of claim 7 wherein adjusting the adjustable post includes retracting or extending the adjustable post relative to the mounting surface.

11. The device of claim 7 further comprising:

a second audio device mounted within the housing, the second audio device positioned flush with the mounting surface or on the first side of the mounting surface.

12. A system for mounting audio devices within a cavity, comprising:

a housing configured for installation on a first side of a mounting surface;

a telescoping assembly coupled to the housing; and a first audio device coupled to the telescoping assembly such that the first audio device can be selectively positioned on the first side of the mounting surface, substantially flush with the mounting surface, and on a second side of the mounting surface by adjusting the telescoping assembly.

13. The system of claim 12 wherein the first audio device can also be positioned on the first side of the mounting surface by adjusting the length of the telescoping assembly.

14. The system of claim 12 further comprising:

a second audio device coupled to the housing, the second audio device positioned adjacent to the mounting surface or on the first side of the mounting surface, an angling device coupled to the telescoping assembly and the first audio device to permit angling the first audio device to be directed along a desired sound dispersion axis.

15. The system of claim 12 further comprising:

an angling device coupled to the telescoping assembly and the first audio device to permit angling the first audio device to be directed along a desired sound dispersion axis, the angling device including a ball-joint socket, a ball coupler sized to fit within the ball-joint socket, the ball coupler capable of rotating within the ball-joint socket, and a lock ring sized to fit around the circumference of the ball-joint socket and tighten the ball-joint socket around the ball coupler.

16. The system of claim 15 wherein the angling device is capable of being angled up to approximately fifty degrees in any direction relative to a perpendicular axis of the mounting surface.

17. The system of claim 15 further comprising:

a third audio device coupled to the telescoping assembly such that it can be positioned on the first side of the mounting surface, substantially flush with the mounting surface, or the second side of the mounting surface by decreasing or increasing the length of the telescoping assembly.

18. The system of claim 15 wherein the telescoping assembly includes an inner post, an outer sleeve configured to slide longitudinally along the inner post, and a first lock ring sized to fit around the circumference of the first end of outer sleeve to tighten the outer sleeve around the inner post and secure telescoping assembly at a desired position.

19. An audio device comprising:

housing means configured for installation on a first side of a mounting surface;

telescoping means coupled to the housing means; and a first audio device coupled to the telescoping means such that the first audio device can be selectively positioned on the first side of the mounting surface, substantially flush with the mounting surface and on a second side of the mounting surface by adjusting the telescoping means.

20. A method of mounting a recessed audio device, comprising:

inserting an audio device housing into a recessed cavity so that the audio device housing is on a first side of a mounting surface, the audio device housing sitting substantially flush with the mounting surface;

securing the audio device housing in the recess cavity; and adjusting the depth of a first audio device coupled to the audio device housing so that it is selectively mounted on the first side of the mounting surface, substantially flush with the mounting surface, and on a second side of the mounting surface.

21. The method of claim 20, further comprising:

adjusting the angle of the first audio device to direct its sound dispersion axis to a desired location;

adjusting the angle of a second audio device coupled to the audio device housing to direct its sound dispersion axis to a desired location, the angle of the second audio device being independently adjustable from the angle of the first audio device.

* * * * *